US006286944B1

(12) United States Patent
Shimizu et al.

(10) Patent No.: US 6,286,944 B1
(45) Date of Patent: Sep. 11, 2001

(54) INK JET UNIT WITH CARTRIDGE HAVING CONTROLLED INK FLOW

(75) Inventors: Eiichiro Shimizu, Urawa; Masami Ikeda; Naohito Asai, both of Yokohama; Tsutomu Abe, Isehara; Toshio Kashino, Chigasaki; Masahiko Higuma, Tohgane; Hitoshi Sugimoto, Yokohama; Hiroki Tajima, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/783,796

(22) Filed: Jan. 15, 1997

Related U.S. Application Data

(63) Continuation of application No. 08/668,633, filed on Jun. 21, 1996, now abandoned, which is a continuation of application No. 08/548,256, filed on Oct. 25, 1995, now abandoned, which is a continuation of application No. 08/247,885, filed on May 23, 1994, now abandoned.

(30) Foreign Application Priority Data

| | | |
|---|---|---|
| May 21, 1993 | (JP) | 5-120160 |
| May 25, 1993 | (JP) | 5-122619 |
| Aug. 24, 1993 | (JP) | 5-209415 |
| Sep. 8, 1993 | (JP) | 5-223685 |
| Sep. 30, 1993 | (JP) | 5-245513 |
| May 13, 1994 | (JP) | 6-099927 |

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 3,967,286 | | 6/1976 | Andersson et al. | 346/140 R |
| 4,571,599 | * | 2/1986 | Rezanka | 347/87 |
| 4,771,295 | | 9/1988 | Baker et al. | 346/1.1 |
| 4,794,409 | | 12/1988 | Cowger et al. | 346/140 R |
| 5,025,271 | | 6/1991 | Baker et al. | 346/140 R |
| 5,155,502 | | 10/1992 | Kimura et al. | 346/140 R |
| 5,157,421 | * | 10/1992 | Kitahara | 347/86 |
| 5,162,817 | | 11/1992 | Tajika et al. | 346/140 R |
| 5,237,342 | | 8/1993 | Saikawa et al. | 346/140 R |
| 5,448,274 | * | 9/1995 | Hirabayashi et al. | 347/86 |
| 5,488,401 | * | 1/1996 | Mochizuki et al. | 347/86 |
| 5,509,140 | * | 4/1996 | Koitabashi et al. | 347/86 |
| 5,619,238 | | 4/1997 | Higuma et al. | 347/86 |

FOREIGN PATENT DOCUMENTS

| | | | | |
|---|---|---|---|---|
| 0378240 | | 7/1990 | (EP) . | |
| 0419192 | | 3/1991 | (EP) . | |
| 0 488 829 | | 6/1992 | (EP) | B41J/2/175 |
| 488829A2 | * | 6/1992 | (EP) | 347/87 |
| 0 542 247 | | 5/1993 | (EP) | B41J/2/175 |
| 547874A2 | * | 6/1993 | (EP) | 347/86 |
| 0 580 433 | | 1/1994 | (EP) | B41J/2/175 |
| 0 581 531 | | 2/1994 | (EP) | B41J/2/175 |
| 0 631 874 | | 1/1995 | (EP) | B41J/2/175 |
| 63087242 | | 4/1988 | (JP) . | |
| 02000522 | | 1/1990 | (JP) . | |
| 4-156339 | | 5/1992 | (JP) | B41J/2/175 |

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

An ink jet unit includes an ink jet head for ejecting ink; an ink cartridge for containing ink to be supplied to the ink jet head; an ink supply member for introducing the ink from the ink cartridge, provided in the ink jet head; a negative pressure generating material in the ink cartridge; an opening for permitting contact between the negative pressure generating material and in the ink supply member; wherein a gap is formed in the opening when the ink supply member is in contact with the negative pressure generating material.

19 Claims, 23 Drawing Sheets

INK JET UNIT WITH CARTRIDGE HAVING CONTROLLED INK FLOW

This application is a continuation of application Ser. No. 08/668,633 filed Jun. 21, 1996 now abandoned, which is a continuation of application Ser. No. 08/548,256 filed Oct. 25, 1995 now abandoned, which is a continuation of application Ser. No. 08/247,885 filed May 23, 1994 now abandoned.

FIELD OF THE INVENTION AND RELATED ART

The present invention relates to an ink container for containing ink to be supplied to an ink jet head, an ink jet unit having the ink container and an ink jet apparatus having the same. It is usable with recording apparatus or communication apparatus such as a copying machine or a facsimile machine, or with a textile printing apparatus for printing image or the like on textile An ink jet recording apparatus is now widely used as a means for effect recording on a recording material such as paper, textile or the like in a printer, facsimile machine, a copying machine or the like. In an ink jet recording apparatus, ink is ejected from a recording head to a recording material faced thereto. In one example, it is independently installed in a casing as an ink jet recording apparatus, and in another example it is built in, as an integral part, in various electronic machines such as a word processor, a personal computer or the like. As regards the structure of an ink accommodating portion used is such an ink jet recording apparatus, it is required that the amount of the ink corresponding to the amount of the ink ejected for the recording, can be properly supplied and that the ink does not leak through the ejection outlet when the recording operation is not carried out. Usually, the ink accommodating portion is in the form of a cartridge which is exchangeable. In one example, the ink accommodating portion is made integral with an ink jet head. When the situation that the ink in the ink container can not be ejected from the ink jet recording head, is reached, the ink accommodating portion is disposed of with the recording head. However, in the ink accommodating portion, some ink still remains. The quantity of the non-usable remaining ink is; determined by an ink retaining power of sponge (negative pressure generating material) occupying the entirety of the inside space of the ink accommodating portion, with the result that the quantity is relatively large. In addition, the recording head has to be exchanged with the ink accommodating portion before the performance of the recording head itself is still enough for the operation. This results in cost increase and low cost-performance. Under the circumstances, a proposal has been made that the recording head and ink cartridge are detachably mountable to permit exchange of the ink cartridge alone. In this case, it is further required that the mounting and demounting between the recording head and the ink cartridge can be smoothly carried out without ink leakage and that the ink can be assuredly supplied when they are coupled together.

Japanese Laid-Open Patent Application No. 87242/1988 discloses an ink accommodating portion integral with the recording head, in an ink jet unit provided with a plurality of ink ejection outlets and a foamed material in an ink accommodating portion. In such an ink accommodating portion, the ink is contained in a porous material such as polyurethane foamed material, and therefore, negative pressure is produced by the capillary force inherent to the porous material, and the ink is retained there, that is, the ink leakage from the ink absorbing material is prevented.

However, since the porous material occupies substantially the entirety of the ink accommodating portion, and therefore, the quantity of the ink capable of being retained thereby is limited, and in addition, the quantity of the ink non-usable remaining ink in the porous material is relatively large, and therefore, the use efficiency of the ink is low. Since the ink is filled in the porous material, it is difficult to detect the Remaining quantity of the ink. Furthermore, there is an additional problem that it is difficult to maintain a substantially constant negative pressure in the ink container when the ink is being consumed.

Japanese Laid-Open Patent Application No. 522/1990 has proposed a solution to this problem. It discloses an ink jet recording cartridge in which a primary ink containing portion and a secondary ink containing portion and further the ink jet recording head are communicated with porous materials. In such a cartridge, the use efficiency is improved because the porous material is not contained in the main part of the ink containing portion but is provided only in the ink passage. In addition, by the provision of the secondary ink containing portion, the ink leakage from the primary ink containing portion attributable to the air expansion in the primary containing portion as a result of pressure reduction due to the temperature rise, can be suppressed. Therefore, the negative pressure during the recording operation of the recording head can be maintained substantially constant.

However, since the negative pressure producing means is provided in the ink passage, the porous material contains an amplitude of the ink with the result of insufficient negative pressure when the recording operation is not carried out. Then, there is a possibility that the ink leaks through the orifices of the ink jet recording head by small impact. The ink jet recording head has been made integral with the ink containing portion beforehand, and therefore, it is not usable in an exchangeable ink cartridge In which the ink cartridge is detachably mounted to an ink jet recording head.

When an ink jet recording head and an ink cartridge are detachably mountable to constitute an ink jet unit, and they are mounted on a carriage of a recording apparatus as a unit, a problem of ink leakage upon the exchange of the ink cartridge alone, is a problem. The ink leakage is different from an ink cartridge disposed remote from the recording head. More particularly, there is a liability that the inside of the apparatus is contaminated, electric connection between the recording head and the recording apparatus may be deteriorated, that the recording material may be contaminated, or the like.

This problem is significant recently because both of the recording head and the cartridge are carried on a carriage for the purpose of machine downsizing.

When an ink supply tube is used for a recording head for fluid communication between the recording head and the ink cartridge, a large quantity of the ink is to be supplied for the purpose of increasing the recording speed of the ink jet recording apparatus, and therefore, a relatively large diameter ink supply tube is desired. Therefore, when an ink cartridge is exchanged, and the ink supply tube is inserted to be press-contacted to the ink absorbing material, the absorbing material is compressed by a tip end of the ;ink supply tube with the result that the ink retained therein seeps out. Then, the ink may be discharged to the outside of the ink cartridge with the result of contamination of the recording apparatus or the recording material.

As described hereinbefore, the easy mounting or demounting is desired between the ink cartridge and the recording head, and therefore, it has been difficult to obviate these problems.

Additionally, in order to maintain a high ejection performance, the position of the recording head is strictly limited, and therefore, the deviation thereof due to external force or vibration has to he prevented. In this sense, it has been required that the recording head is not pushed by an ink cartridge when the ink cartridge is mounted thereto To achieve this, it is considered that the ink cartridge imparts the load only in a predetermined direction. In such a case, various direction limiting means have to be provided with the result of complicated structure and/or a bulky structure.

SUMMARY OF THE INVENTION

Accordingly, it is a principal object of the present invention to provide an exchangeable ink jet unit with which an ink container can be easily coupled with a recording head.

It is another object of the present invention to provide an ink jet unit in which an ink container applies only a limited load to the recording head when the ink container is coupled with the recording head.

It is a further object of the present invention to provide an ink jet unit with which performance of an ink jet unit can be maintained for a long term while the ink jet unit is kept loaded In the ink jet recording apparatus.

It is a yet further object of the present invention to provide an ink jet unit in which the ink leakage from an ink container can be effectively prevented irrespective of mode of use.

According to an aspect of the present invention, there is provided an ink jet unit comprising: an ink jet head for ejecting ink; an ink cartridge for containing ink to be supplied to the ink jet head; an ink supply member for introducing the ink from the ink cartridge, provided in the ink jet head; a negative pressure generating material in the ink cartridge; an opening for permitting contact between the negative pressure generating material and in the ink supply member; wherein a gap is formed in the opening when the ink supply member is in contact with the negative pressure generating material.

Since a portion of the ink cartridge which defines the opening is not contacted to a joint portion of an ink jet recording head, and therefore, no external force is imparted to the recording head except for the force required for pressing the negative pressure generating material in the ink cartridge. Thus, an ink cartridge, an ink jet unit and an ink jet apparatus capable of assuring satisfactory printing operation, is provided.

According to another aspect of the present invention, the ink supply member is provided with a recess, which is located adjacent an end of the ink supply member so as to be located in the ink cartridge when the ink jet head and the ink cartridge are connected.

By doing so, the ink leakage can be further prevented.

According to a further aspect of the present invention, press-contact member which is between the gap and an ambience when the ink jet head and the ink cartridge are connected, the press-contact member is provided in either of the ink jet head or ink cartridge.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 5A, 5B and 5C are sectional views of an ink jet head constituted by coupling an ink cartridge with an ink jet head, wherein FIG. 5A is an overall view of the ink cartridge and ink jet head, FIG. 5B is a enlarged view of the coupling between an ink cartridge and ink jet head, and FIG. 5C is an enlarged view of the heating elements within the ink jet head.

DESCRIPTION OF THE PREFERRED EMBODIMENTS

Referring to the accompanying drawings, the embodiments of the present invention will be described in detail.

Figure 1:
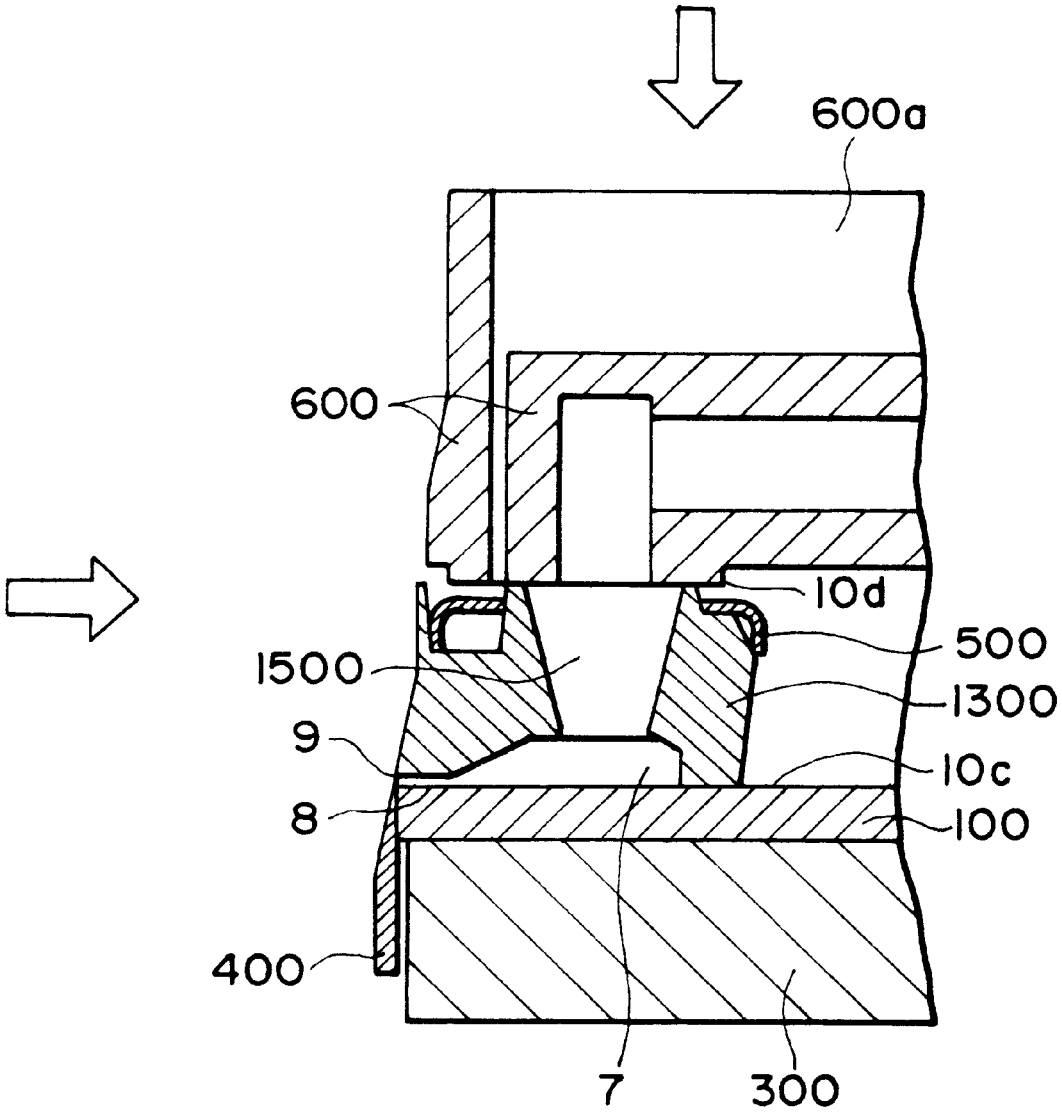
FIG. 1 is a sectional view of a part of an ink jet recording head usable with the present invention.

Referring first to FIG. 1, there is shown a major part of an ink jet head (recording head) usable with an embodiment of the present invention.

As shown in this Figure, the recording head comprises a substrate 100 (heater board) having thermal energy generating elements, and a substrate 1300 having grooves for constituting ink passages 8 and a liquid chamber 7 for containing recording liquid (ink) when coupled with the substrate 100. The substrate (top-plate with grooves) 1300 has an integral orifices plate 400 provided with ink ejection outlets (orifice's) through which ink is ejected and which are in liquid communication with the ink passages 8. respectively.

The heater board 100 is bonded by a bonding material on the supporting substrate (supporting member) 300. The top plate 1300 is temporarily bonded to the heater board 100 so that the thermal energy generating elements on the heater board 100 are contained in ink passages 8 constituted by the coupling therebetween. The orifice plate 400 of the top plate is in the form of an apron at a front end of the supporting base plate 300.

The ink is supplied from an ink supply member 600 through an ink supply port 1500 formed in an upper portion of the top plate 1300. The ink supply passage member 600 is provided with a projected road, which is inserted into a through hole formed in the supporting substrate 300, and then is cramped by heat so as to be fixed on the supporting substrate 300.

Figure 2:
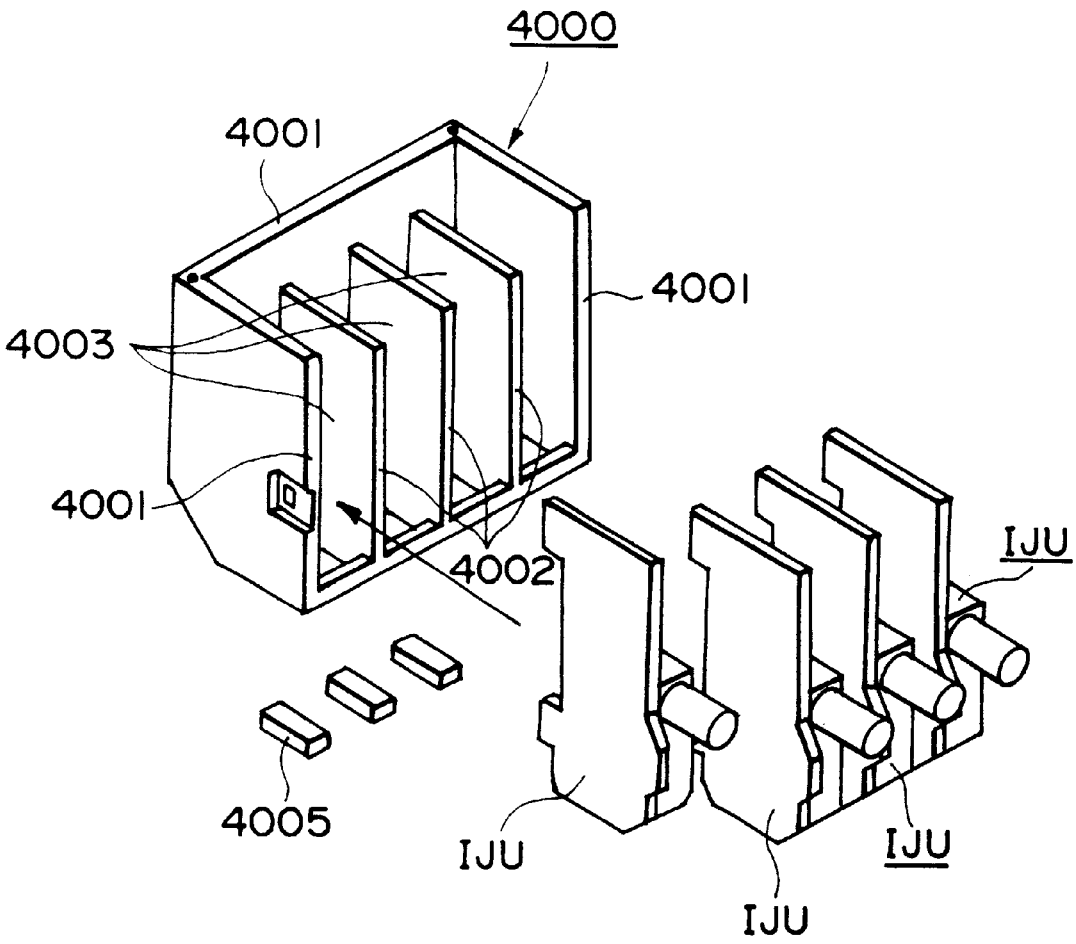
FIG. 2 is an exploded perspective view, without a housing therefor, of an ink jet head unit comprising a plurality of the ink jet heads shown in FIG. 1.
Figure 3:
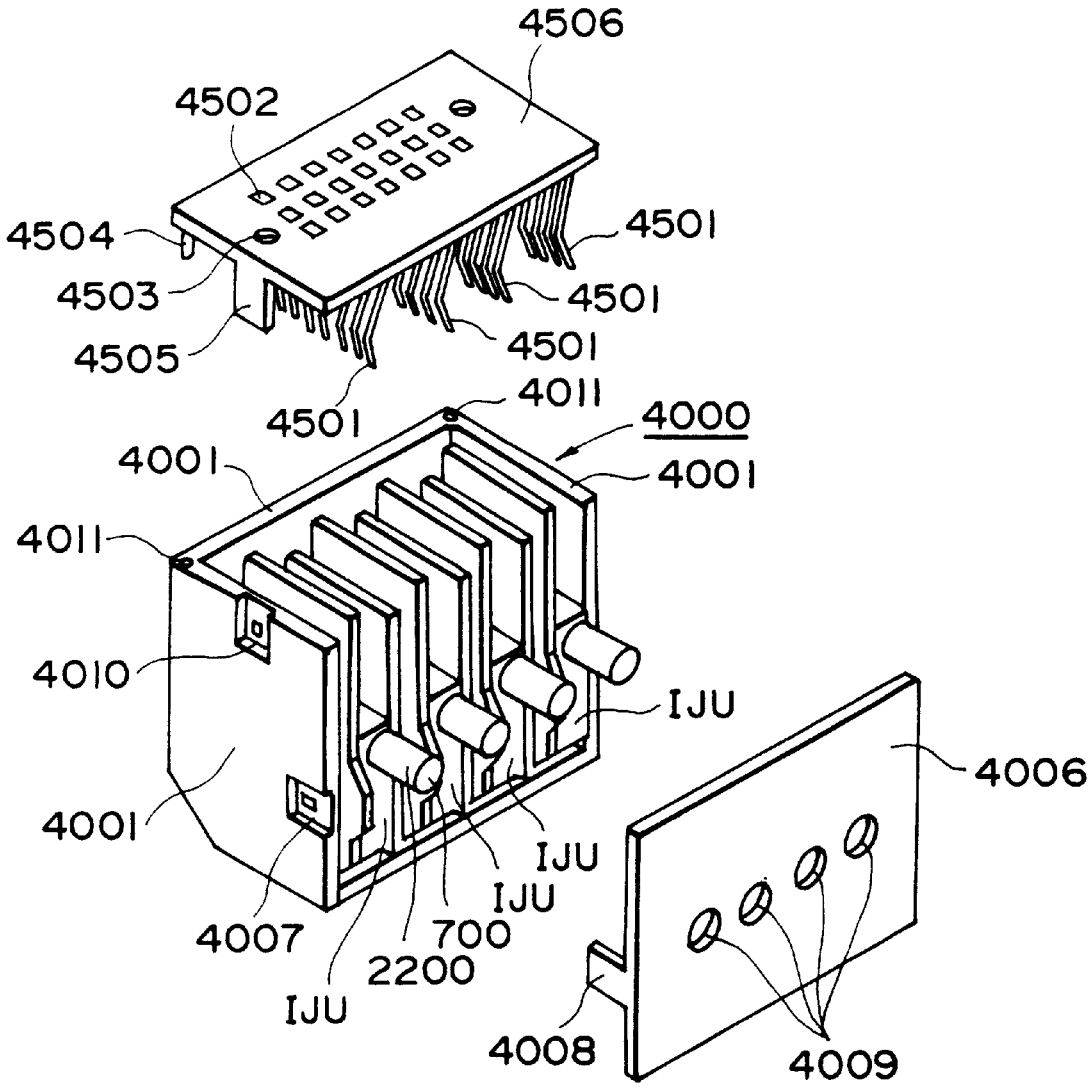
FIG. 3 is an exploded perspective view of an ink jet head unit of FIG. 2.

FIGS. 2 and 3 illustrate an embodiment of the present invention and are exploded perspective views of a recording head unit having a plurality of recording heads having the structure shown in FIG. 1. In FIG. 2, housing member for the unit has been omitted In FIG. 2.

In the Recording head unit of this embodiment, four recording heads capable of ejecting different color inks are mounted with precise relative positions among them. The four recording heads may eject the same color ink, in which case, a high speed recording or tone recording (in accordance with the number of droplet of the ink) is possible. Alternatively the recording leads may eject same color but different density inks to effect the tone recording. In FIG. 2, a unit frame 4000 comprises an outer plate 4001 in the form of a channel and three internal wall plates 4002 for defining a head retaining portion 4003 for accommodating the recording heads. The recording head IJU of FIG. 1 is accommodated in the head retaining portion 4003 with the ink ejection outlet directed downward. For the purpose of precise positioning of the recording head in the unit frame 4000, reference surfaces of each of the recording heads are abutted to three directional reference surfaces of the head retaining portion, and thereafter, they are fixed by adhesive material or the like. Here, the positional relationship between the orifice and the reference surfaces is desirably highly precise.

As for the method of positioning the recording heads IJU, TV camera or the like is used to correctly position them on a monitor, and then, they are bonded, with out using the reference surfaces described above.

In this manner, according to the present invention, four recording heads are fixed to the unit frame, and the recording head is exchanged as a unit, and therefore, the relative positional relationship among the four recording heads is maintained even after the exchanging operation. In addition, the recording heads are accommodated in the unit frame, and are fixed therein, and therefore, a wide latitude in the design is permitted, as compared with the recording head ejecting different color inks.

In FIG. 2, a porous material 4005 capable of absorbing the ink is disposed between adjacent recording heads IJU adjacent to the sides having the orifices. When the orifice surfaces are wiped by a blade, the porcus material absorbs the ink from the blade, so that the deposition of the different color ink on the orifice side surface can be prevented.

In FIG. 3, a top housing 4506 and a side housing 4006 are fixed to the unit frame 4000. For fixing the top housing, a pair of pins 4504 (only one is shown) is inserted into holes 4011 formed in a top surface of the outer wall plate 4001 of the unit frame 4000, so that the top housing 4506 is correctly positioned. Unshown projections of engaging plates 4505 formed at the opposite ends of the top housing, are engaged with recesses 4010 formed in the outer wall plate with elasticity of the engaging plates 4505, so that they are fixed. As regards the fixing of the side housing 4006 to the unit frame 4000, is effected similarly, using a pair of engaging plate 4008 of the housing 4006 and recesses 4007 of the unit frame 4000.

The outer surface of the top housing 4506 is provided with a plurality of pads 4502 functioning as electric contact of the recording head IJU. The respective pads 4502 are electrically connected with terminals 4501 extending to the backside of the top housing 4506. The respective terminals 4501 are contacted with associated pads on the substrate of the recording head, when the housing 4506 is fixed to the unit frame.

The side housing 4006 is provided with a hole 4009 for permitting insertion of an ink supply pipe 2200 (joint portion) as an ink supply member of the recording head IJU. When they are connected, the ink supply pipe 2200 is projected through the hole 4009, so that the supply pipe is inserted into the ink cartridge to permit introduction of the ink into the recording head.

Figure 4:
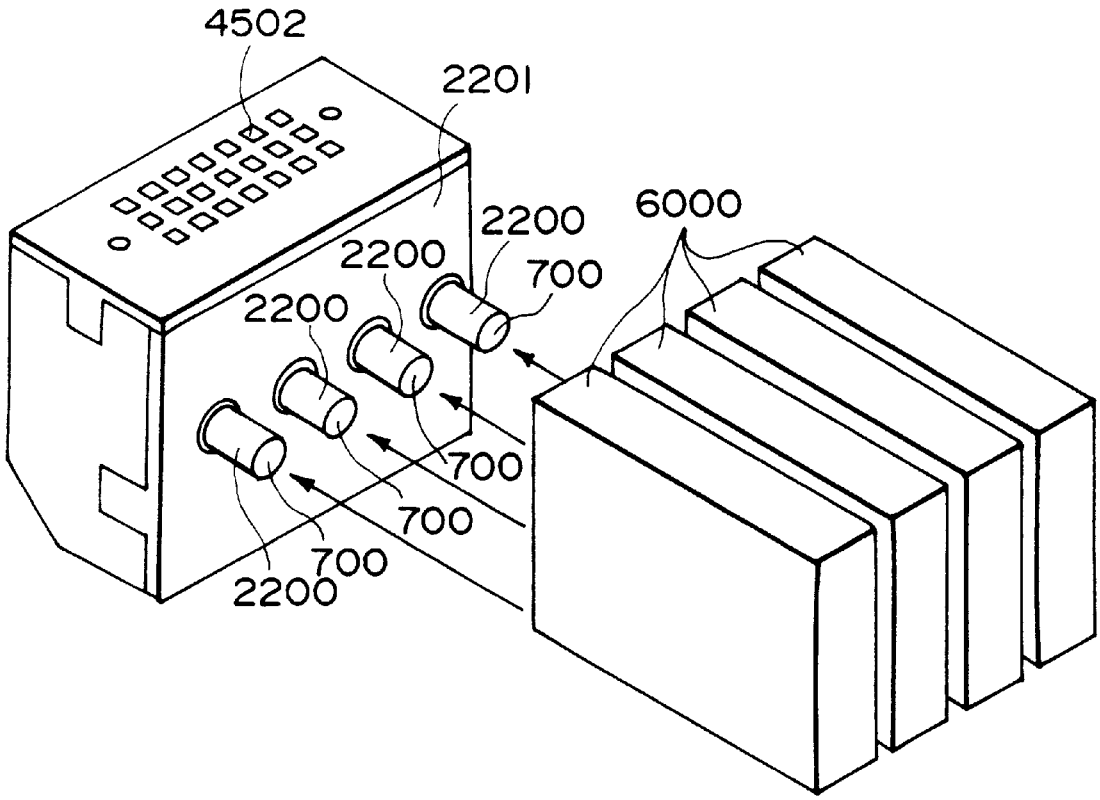
FIG. 4 is a perspective view illustrating coupling between an ink jet head unit and an ink cartridge.

FIG. 4 is a perspective view illustrating coupling between an ink jet head unit and an ink cartridge shown in FIGS. 2 and 3. FIG. 5 is a sectional view an ink jet unit constituted by coupling the ink jet head unit and an ink cartridge.

As shown in FIG. 4, each of ink containers 6000 containing respective color inks, is connected with the associated one of the recording heads by insertion of the ink supply pipe 2200 of the recording head through the opening (not shown). When the ink container 6000 is removed from the recording head, the ink containers 6000 can be removed independently from each other. In the Figure, designated by a reference numeral 2201 is a head fixing wall for fixing a plurality of the ink jet recording heads.

With this structure, the ink container may be replaceable when the ink container 6000 becomes empty. Since the replacement is possible for each of the ink containers, the quantity of the wasted ink materials can be avoided in the case of color ink jet recording.

Figure 5A:
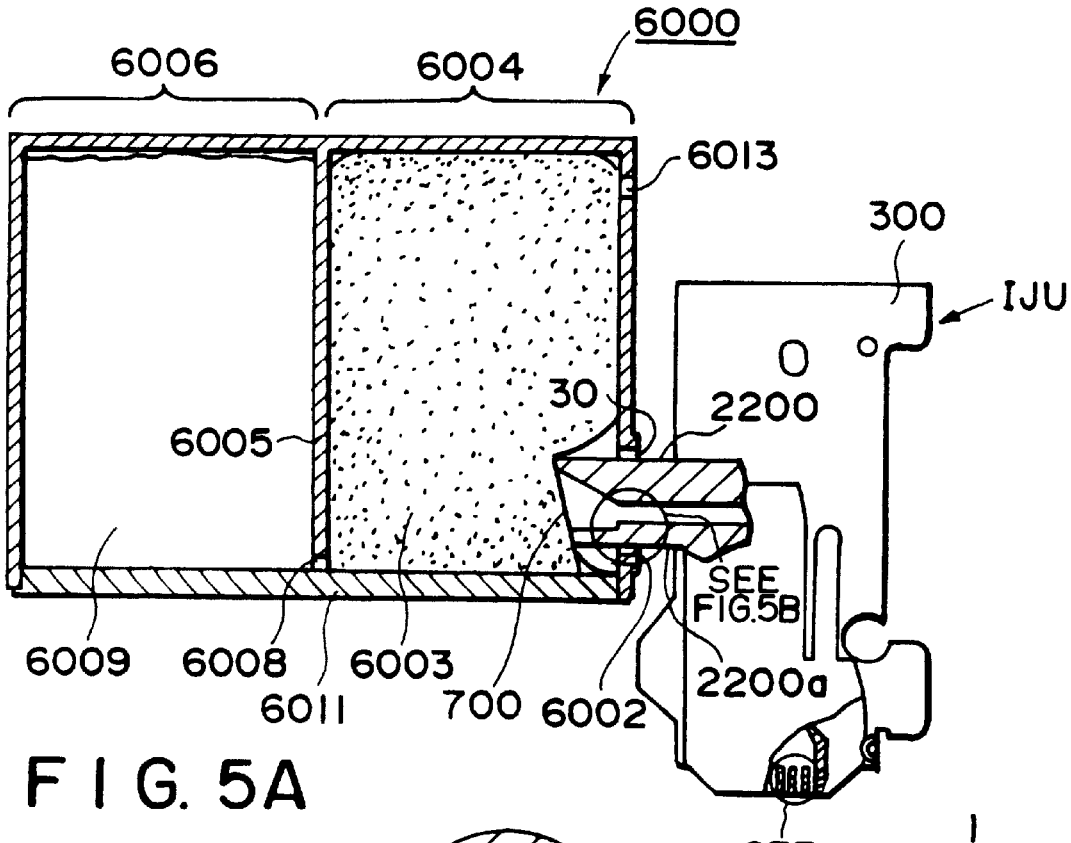

In FIG. 5A, the supply pipe 2200 of the recording head IJU is inserted such that a filter 7000 provided at the tip end thereof is press-contacted to an absorbing material 6003 in the ink container 6000. The ink chamber 6006 is filled with ink 6009. The ink is filled in a part of the absorbing material 6003 in a front chamber 6006 isolated by a partition wall 6005 of an ink chamber 6006. The absorbing material 6003 has enough capillary to retain the ink, so that the ink is prevented from leaking through the opening 6002. The ink 6009 in the ink chamber 6006 is supplied into the front chamber 6004 through a slit 6008. The ink supply is permitted because an amount of the ink corresponding to the ink amount consumed by the ink supply to the recording head IJU is introduced into the ink container through an air vent 6013.

Referring to FIGS. 1–5, more detailed explanation will be made. The ink container 6000 in the form of an exchangeable ink cartridge is slid rightwardly in FIG. 5A relative to the ink jet recording head IJU fixed in the apparatus to such an extent that the ink supply pipe 2200 (joint portion) of the ink jet recording head IJU is inserted through the opening 6002 by a predetermined degree. As shown in FIG. 5B, a sufficient gap is provided between the internal wall 6002*a* of the opening 6002 of the cartridge 6000 and an external wall 2200*a* of the ink supply pipe 2200 of the ink jet recording head IJU. The sufficient gap is desirably more than that provided by manufacturing tolerances between the supply pipes and the opening. Due to the sufficient gap therebetween, the contact between the outer wall of the joint portion of the recording head IJU and the periphery of the opening 6002, can be avoided.

In consideration of possible leakage of the ink upon coupling the ink cartridge with the recording head and the ink evaporation, the sufficient gap is as follows.

Figure 5B:
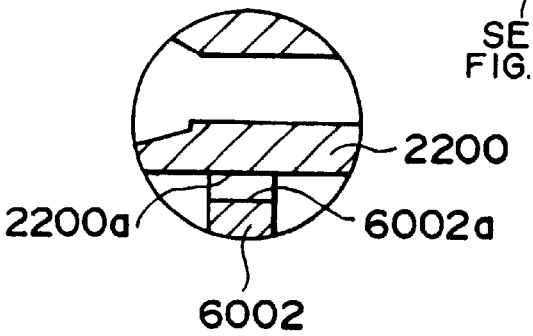
Figure 5C:
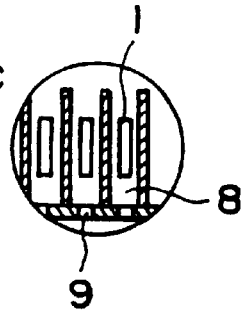
Figure 6:
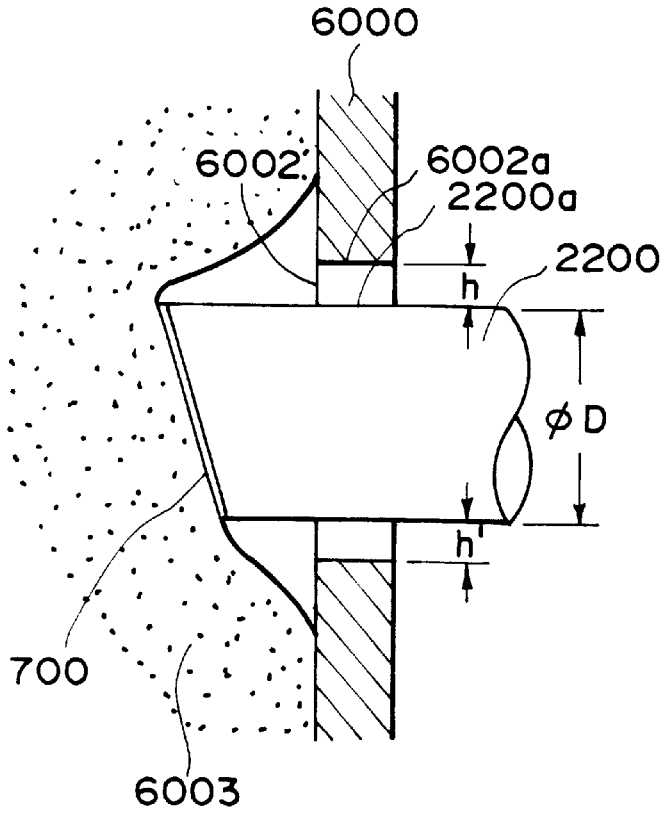
FIG. 6 is a sectional view illustrating a coupling portion between the ink jet head unit and the ink cartridge.

As shown in FIG. 6, an ink supply pipe has a diameter of D, and a gap h and h' are formed at an upper portion and lower portion, respectively, between an external surface 2220*a* of the ink supply pipe and an internal wall of the ink cartridge opening, in a cross-section. In FIG. 6, the same reference numerals as in FIGS. 5A and 5B are assigned to the corresponding elements.

When the ink supply pipe 2200 is inserted through the opening 6002 of the ink cartridge 6000, the air is forced into the ink cartridge with the inserting action of the ink supply pipe, if there is no gap. This may result in an air rich area is formed adjacent the tip end of the ink supply pipe. If this occurs, the ink supply may become improper. In addition, if the gap is small, the ink is formed into a meniscus between the internal wall of the opening and the external wall of the ink supply pipe, if the ink exists adjacent the internal wall of the opening. Then, when the air thus introduced is going to discharge to then outside, it may push the ink forming the meniscus to the outside of the ink cartridge. In order to avoid this, the gap desirably satisfies $h+h' \geqq 0.3$ mm in consideration that the meniscus is easily formed if the gap is not more than 0.3 mm when usual ink is used. Further preferably, $h+h' \geqq 0.6$ mm, since then the formation of the meniscus can be avoided with further certainty. Thus, the ink leakage can be prevented when the diameter of the opening of the ink cartridge is larger than the outer diameter of the ink supply pipe at least by 0.3 mm, further preferably, at least by 0.6 mm.

When the gap is large, evaporation of the ink from the negative pressure generating material may be a problem. The ink evaporation occurs adjacent the outer periphery at the tip end of the ink supply pipe. The ink passage formed between the negative pressure generating material and an ink supply passage (not shown) in the ink supply pipe becomes gradually narrow in this case, when a recovery operation is carried out, air bubbles or the like are introduced into the recording head with the possible result of improper ink ejection. In order to avoid this, it is preferable that $(h+h')/D \leqq 0.6$ is satisfied, further preferably $(h+h')/D \leqq 0.3$ is satisfied. Then, the ink evaporation can be suppressed so as not to influence the formation of the ink passage.

Referring to FIG. 5A, the operation will be described. In this Figure, the ink supply pipe 2200 of the ink jet recording head IJU is inserted to such an extent of sufficient press-contact relative to the negative pressure generating material, so that the operation of the ink jet recording apparatus is enabled. A filter 700 is used to avoid foreign matter in the ink cartridge 6000, at an end of the ink supply pipe 2200.

Figure 7:
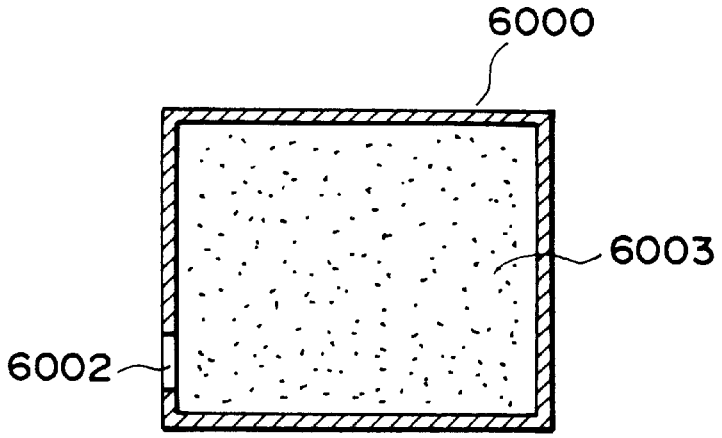
FIG. 7 is a sectional view of an ink cartridge containing a porous material.
Figure 8A:
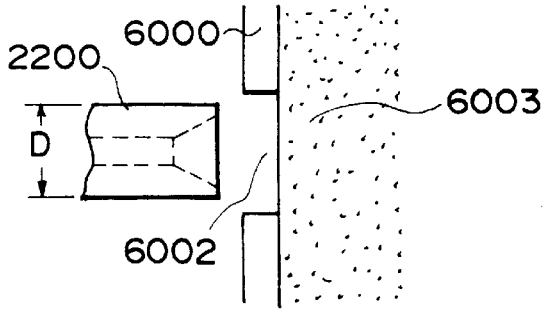
FIGS. 8A, 8B, 8C and 8D are sectional views illustrating connection between an ink jet head and an ink cartridge, wherein they are not coupled in FIG. 8A; they are being coupled in FIG. 8B; they are being separated in FIG. 8C; and they are recoupled in FIG. 8D.
Figure 8B:
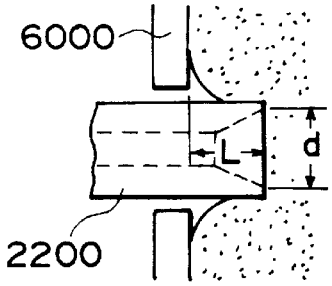
Figure 8C:
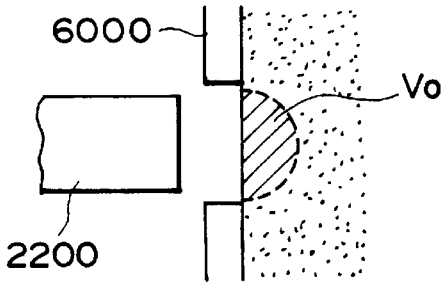
Figure 8D:
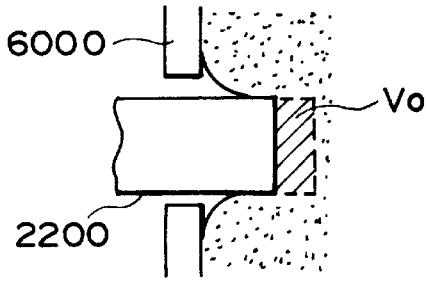

The ink cartridge usable with the present invention, as shown in FIG. 7, may contain the porous material 6003 occupying substantially the entirety of the inside space of the ink cartridge. However, in consideration of the use efficiency of the ink cartridge, the ink cartridge shown in FIG. 5 is preferable.

The description will be made as to the ink cartridge shown in FIG. 5A. When the ink jet recording apparatus is operated, the ink is ejected through the orifices 9 of the recording head IJU, so that sucking force is produced in the exchangeable ink cartridge. The ink 6009 is introduced by the sucking force from the ink accommodating portion 6006 into the ink supply pipe 2200 through a gap 6008 formed between a rib end and a cartridge bottom 6011 and through the negative pressure generating material accommodating portion 6004 (front chamber) and the negative pressure generating material 6003. Thus, the ink is supplied to the ink jet recording head. By this, the pressure in the ink accommodating portion 6006 which is hermetically sealed except for the gap 6008, decreases with the result of pressure difference between the ink accommodating position 6006 and the negative pressure generating material accommodating portion 6004. With the continuing recording operation, the pressure difference continues to increase. Since the negative pressure generating material 6003 is opened to the ambience by an air vent 6013 or a clearance formed between the ink supply member 2200 and an opening 6002, and therefore, the air is introduced into the ink accommodating portion 6006 through the negative pressure generating material 6003 and through the gap 6000 between the rib end and the cartridge bottom 6011. When this occurs, the pressure difference between the ink accommodating portion 6006 and the negative pressure generating material accommodating portion 6004 is removed. During the recording operation, this action is repeated, and therefore a certain constant degree of the negative pressure is maintained in the ink cartridge. Almost all of the ink except for the ink deposited on the internal wall surface of the ink accommodating portion, can be used, and therefore, the use efficiency is improved.

When the recording operation is not effected, the capillary force provided by the negative pressure generating material (or meniscus force at the interface between the ink and the negative pressure generating material) functions to prevent leakage of the ink from the ink jet recording head.

In accordance with the types of the ink jet recording heads to be coupled, the negative pressure generating material and the volume ratio between the negative pressure generating material accommodating portion and the ink accommodating portion can be determined to accomplish proper printing operation. In addition to the increase of the ink accommodating amount as compared with the case of the porous material occupying substantially the entirety of the ink cartridge, the ink leakage through the opening can be effectively prevented.

As for a color ink jet recording apparatus, the exchangeable ink cartridges of this embodiment are usable to contain different color inks (black, yellow, magenta and cyan, for example). These cartridges may be formed into a unit to constitute a single exchangeable ink cartridge. Alternatively, the cartridge for the black ink which is most frequently used, may be made separable from the other part having the other color cartridges. Proper combinations can be selected for the types of ink jet recording apparatuses.

In order to properly control the negative pressure in the ink jet recording head using the exchangeable ink cartridge of this embodiment, proper selection or determination is made as to material selection, configuration, dimension of the negative pressure generating material 6003, configuration and dimension of the rib end, configuration and dimension of the gap 6008 formed between the rib end and the cartridge bottom 6011, volume ratio between the negative pressure generating material accommodating portion 6004 and the ink accommodating portion 6006, degree of insertion, configuration and dimension of the insertion of the ink supply pipe 2200 into the ink cartridge, configuration, dimension and mesh of the filter 700, and surface tension of the ink.

As for the negative pressure generating material, a known material is usable, provided that the material exhibits proper ink retaining power against the weight: of the liquid (ink) and small vibration. For example, felt like material of fibers, or porous material having continuous pores, is usable. Polyurethane foamed material, melamine foamed material or another sponge is preferable because the ink retaining power and the vacuum generation is easily controllable.

Particularly in the case of the foamed material, a proper density of pores can be adjusted during the foaming. When the density of pores is further adjusted by heat-compression treatment of the foamed material, decomposition products occur with the possible result of adverse influence to the printing quality because of changing the ink property. Therefore, in this case cleaning is required. To meet various types of ink jet recording apparatuses, the materials have corresponding densities of pores, are produced. To do this, it is desirable that a foamed material (not heat-compressed) having a determined porosity (number of pores per 1 inch) is cut into selected dimensions, and the density of pores and the capillary force are adjusted by pressed into the negative pressure generating portion, so that they are controlled by the degree of the compression, although the density of the pores is constant.

As described hereinbefore, if the gap is enough between the ink supply pipe 2200 and the opening 6002, the structure and the configurations are not limited to those described above.

In the case that the use is made with the porous material such as sponge, the end of the ink supply pipe 2200 is preferably tapered with respect to the inserting direction of the ink supply pipe, in order to suppress the removal of the porous material from the bottom of the ink cartridge and in order to maintain and assure the press-contact between the filter and the negative pressure generating material.

The degree of insertion of the ink supply pipe 2200 into the cartridge 6000 is determined in consideration of the configuration of the ink supply pipe and the configurations of the ink cartridge 6000 and the negative pressure generating material 6003, so as to avoid the ink leakage upon the inserting action and so as to avoid the ink disconnection during the recording operation.

The degree of insertion of the ink supply pipe 2200 into the ink cartridge 6000 is preferably determined in consideration of the following.

Since the ink cartridge is a replaceable type, the user necessarily manipulate the ink cartridge in the initial mounting or after the initial mounting. Particularly, the user may mount of demount it without specific purposes. If this is done, ink disconnection or the ink leakage occurs.

FIG. 6 illustrates the situation in which the mounting and demounting are repeated. In this example. as a simple examples the ink supply pipe 2200 is nut tapered.

Shown in FIG. 5A is the situation before the supply pipe 2200 of the recording head is immediately before inserted into the opening 6002 of the cartridge 61000. Here, the supply pipe has a diameter D.

In the state shown in FIG. 8. the ink cartridge has been mounted on a carriage (not shown); the supply pipe 2200 is press-contacted to the negative pressure generating material 6003; it is inserted by a distance L from the internal wall of the negative pressure generating material accommodating portion; and the jointing action is completed.

If the degree of insertion L is not enough, the compression ratio of the negative pressure generating material 6003 is not enough, so that the air is introduced into the negative pressure generating material through the opening 6002. The introduced air reaches to the end portion of the supply pipe 2200 with the result of the air is carried over to the recording head, or the filter is clogged. If this occurs, the ink disconnection may occur.

In order to avoid this, it is desirable that the degree of insertion is not less than one half the diameter d of the opening at the contact portion, where d is a maximum inner diameter of the supply pipe 2200. This has been empirically confirmed.

That is, $L \geqq d/2$ is desirable from the standpoint of concentrating the. ink to the neighborhood of the ink supply pipe 2200 by the compression of the negative pressure generating material.

If the mounting and demounting are repeated, as shown in FIG. 8, the configuration of the negative pressure generating material abruptly restores to the original configuration upon removal of the supply pipe 2200. However, the ink in the negative pressure generating material is unable to move at such a high speed so that the air is introduced through the opening 6002. Then, an air rich portion occurs as indicated by V0. Even if the supply pipe is reinserted, the air rich portion V0 remains adjacent the end of the supply pipe 2200.

When a pump Suction quantity V of a recovery pump not shown for sucking the ink for the purpose of recovering the ink ejection function provided in the recording apparatus, is smaller than V0, the air in the region V0 is not sufficiently sucked with the result of ink disconnection.

The volume of the region V0 is expressed as follows:

$$V0=(4/3)\pi L(D/2)^2$$

where L is insertion and D is an outer diameter of the supply pipe.

Therefore, the pump sucking quantity is preferably not less than $(1/3)\pi LD^2$.

To avoid the ink disconnection despite repeated mounting and demounting, the degree of insertion L of the supply pipe desirably satisfies:

$$3V/D^2\pi \geqq L \geqq d/2$$

where V is a sucking quantity of the recovery pump, D is an outer diameter of the supply pipe, and d is an inner diameter thereof.

As shown in FIG. 7, the similar advantageous effects are provided in the case of the replaceable ink cartridge containing a negative pressure generating material substantially in the entirety of the ink accommodating portion.

As described hereinbefore when the configuration or the end of the ink supply pipe 2200 is changed, the upper limit of the degree L of insertion is determined on the basis of the volume of the air rich region and the sucking quantity V.

By doing so, the ink leakage and the ink disconnection can be avoided, and the proper recording operation can be started instantaneously even in the case. of the replaceable type ink cartridge.

Figure 9:
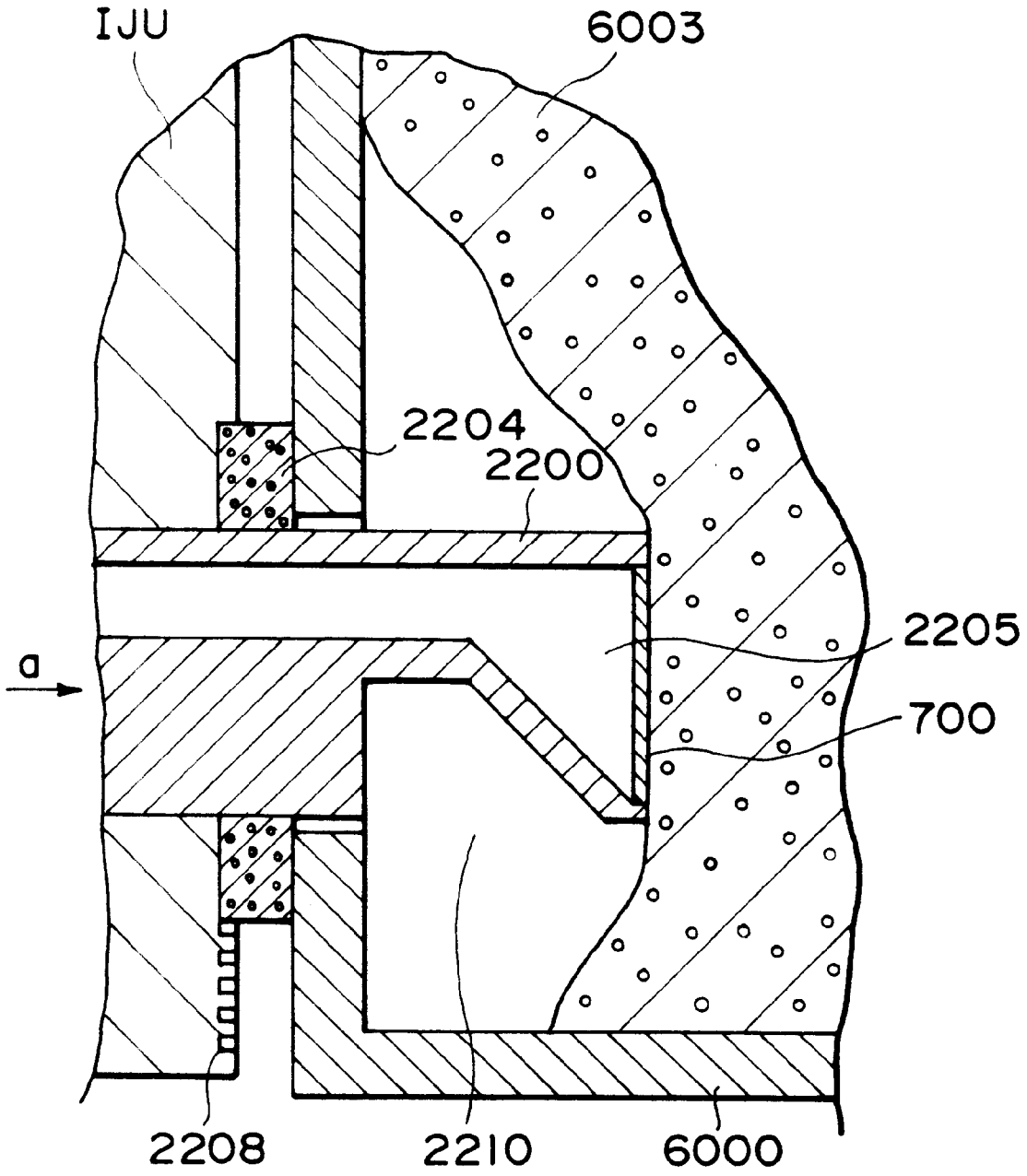
FIG. 9 is a Sectional view illustrating an example of coupling between an ink jet head and an ink cartridge.

FIG. 9 shows another embodiment.

The ink container 6000 contains an ink absorbing material 6003 as the negative pressure generating material. The ink is retained in the pores of the absorbing material 6003 which is a porous sponge having an elasticity. The ink is absorbed and retained by the capillary property of the porous material.

The ink jet recording head unit IJU is provided with an ink supply pipe 2200 for supplying the ink to the recording head from the absorbing material 6003. The end of the ink supply pipe adjacent the opening of the absorbing material 6003, a filter 700 contactable to the absorbing material 6003 is provided. The filter is effective to small foreign matters in the ink and to prevent introduction of small bubbles into the ink supply passage 2205.

As shown in the Figure, a joint seal 2204 of an elastic material may be provided for the purpose of suppressing evaporation of the ink. Below the ink supply Pipe 2200, an ink sump 2208 may be provided to prevent contamination of the other part of the ink jet recording apparatus when the ink leaks from the ink container 6000.

As shown in FIG. 9, the ink supply pipe 2200 has a neck 2210 which is within the ink container 6000 when properly inserted.

The neck 2210 is formed so as to retain the ink seeped out of the absorbing material when the ink supply pipe 2200 is press-contacted to the absorbing material 6003, so as to accommodate the ink as much as possible. The neck or recess is preferably as large as possible downwardly as shown in FIG. 9 because the seeped ink at the upper portion of the ink supply pipe 2200 sooner or later lowers by the gravity.

Figure 10:
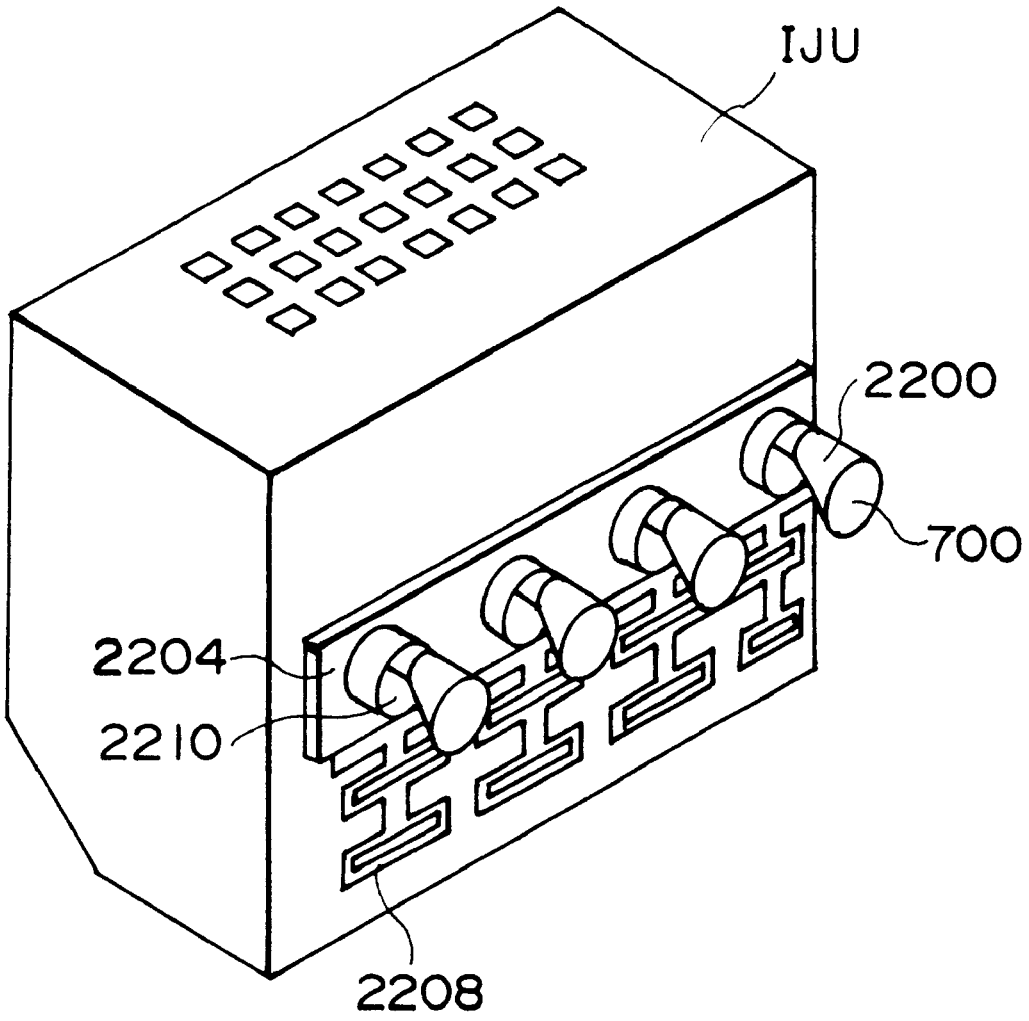
FIG. 10 is a perspective view of an ink jet head unit using the structure of FIG. 8 in another example.

FIG. 10 shows an example of a recording head unit to provide the cross-sectional configuration shown in FIG. 9. The same reference numerals as in FIG. 8 are assigned to the corresponding elements.

In FIG. 10, the end portion of the ink supply pipe 2200 is conical, hut the end portion configuration is not limited to the conical.

Thus, the ink discharged from the absorbing material 6003 when it is compressed by the end portion of the ink supply pipe 2200, when the ink supply pipe 2200 is inserted into a new ink container 6000, is received by the recess 2210 provided by the neck of the ink supply pipe 2200, and therefore, the leakage and therefore the contamination can be avoided.

Figure 11:
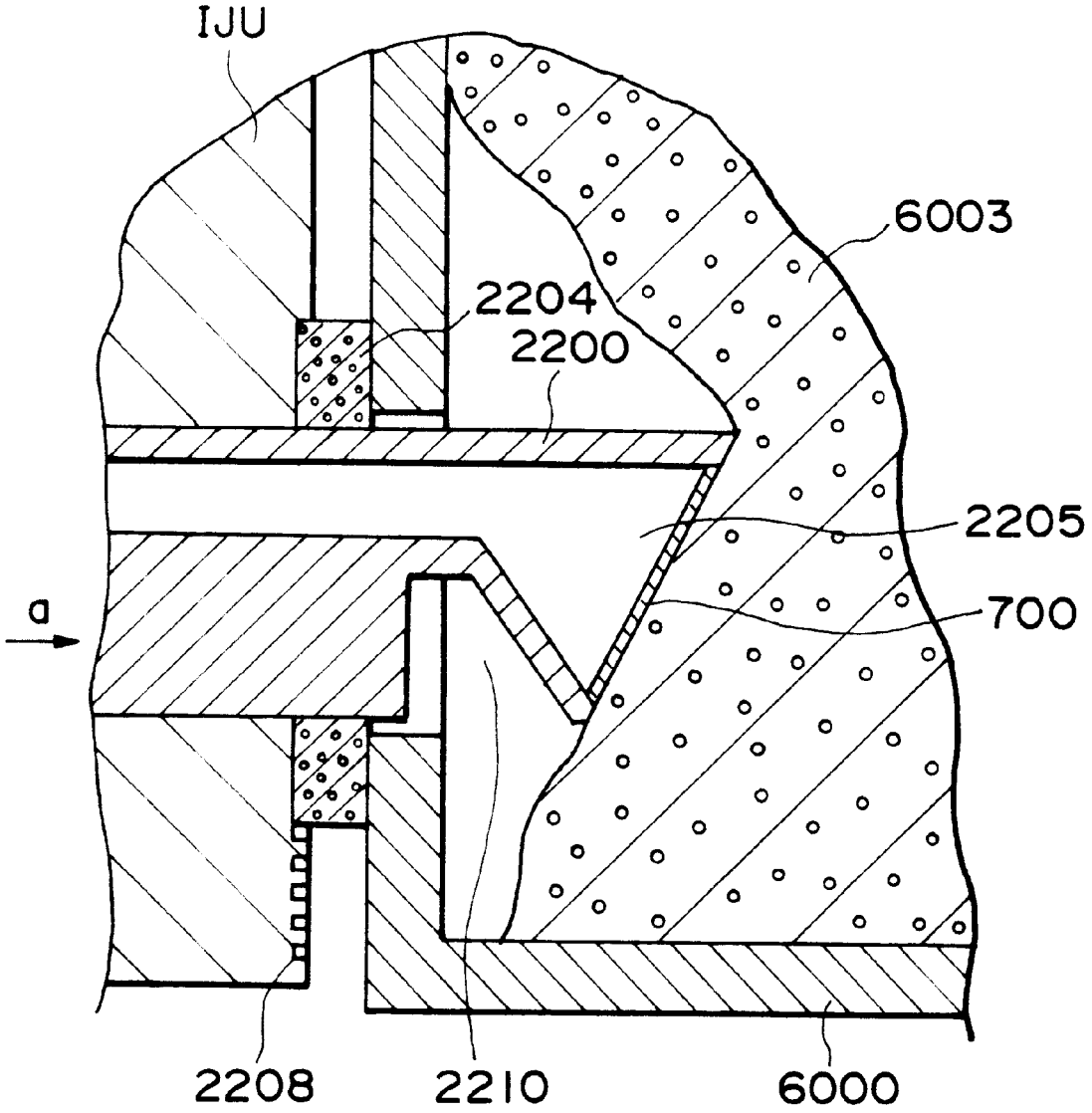
FIG. 11 is a sectional view illustrating coupling between an ink jet head and an ink cartridge, in a further example.

FIG. 11 is a sectional view of an ink jet head unit IJU according to another embodiment of the present invention. The same reference numerals as in FIG. 8 are assigned to the corresponding elements, and the description thereof are omitted for simplicity.

In this embodiment, the end of the ink supply pipe 2200, that :is, the filter 7000, is inclined relative to the direction of insertion a.

With this structure, the volume of insertion of the ink supply pipe 2200 into the ink container is reduced, so that: the amount of the seeping ink from the absorbing material 6003 is reduced when the ink supply pipe 2200 is press-contacted the absorbing material 6003. Thus, the ink leakage can be suppressed. The advantageous effects of the FIG. 9 embodiments can be effectively provided. By the tapered structure, it can be avoided that the porous material tends to be separated from the internal wall surface of the ink cartridge upon the ink supply pipe 2200 insertion, and in addition the proper press-contact is established between the filter and the negative pressure generating material (porous material).

As described in the foregoing, by the provision of the recess in the ink supply passage 2200, the recording ink (seeped out of the absorbing material compressed by the tip end of the ink supply pipe upon the insertion of the ink supply pipe into a new ink container) is received by the recess 2210 formed at a part of the inserted portion of the ink supply pipe, and therefore, the leakage of the ink container can be prevented, and therefore, the ink does not contaminate the outside.

When the structure of providing the ink sump for receiving the leaked ink adjacent the connecting portion between the ink supply pipe and the ink cartridge supply port, in addition to the above structure, the. leaked ink is received by the ink sump even if a small amount of ink leaks from the ink container, and therefore, the contamination is further assuredly prevented.

A configuration and dimension of the gap 6008 between the rib end and the ink cartridge bottom 6011 shown in FIG. 5, can be determined properly by one skilled in the art. If it is too narrow, the meniscus force relative to the ink is too strong with the result that although the ink leakage through the opening 6002 can be prevented, the proper ink supply to the front chamber 6004 requires larger power, and therefore, ink disconnection may occur during use. If it is too wide, an opposite phenomenon may occur. These facts are to be considered in the determination. The gap 6008 is desirably determined in consideration of the position of the opening 6002.

It is preferably 0.1–20 mm approximately, or further preferably 0.5–5 mm, although it is dependent on the configuration and the dimension of the ink cartridge. The configuration of the rib may be any if the positional relation with the opening 6002 is properly considered by skilled in the art.

The interface between the rib end and the negative pressure generating material will be considered. When the negative pressure generating material is not compressed by the rib end, for example, the density of the material is low so that the flow of the ink and that of the air is relatively quick. This is preferable for a high speed recording mode or a color recording mode. On the other hand, when the negative pressure generating material is compressed by the rib end, the density of the material is relatively high. In this case, the flow of the ink or that of the air is relatively impeded, but the ink leakage can be suppressed more against ambient condition change. Therefore, it is determined in consideration of the types of the ink jet recording apparatus and then ambient condition under which the apparatus is used.

The volume ratio between the negative pressure generating material accommodating portion 6004 and the ink accommodating portion 6006, is determined in consideration of the types of the ink jet recording apparatus or the ambient condition. Also, relation with the used negative pressure generating material is also considered.

The configuration, dimension and mesh of the filter 700 are determined depending on the types of the ink jet recording apparatus. From the standpoint of avoiding clogging of the nozzle of the recording head by properly preventing introduction of foreign matter from the ink cartridge, the mesh of the filter is preferably smaller than the diameter of the orifice.

Known ink is usable for the replaceable ink cartridge of this invention. To prevent the ink leakage, the surface tension is preferably not less than 30 dyne/cm at 25° C., further preferably not less than 45 dyne/cm; the viscosity thereof is 1–20 cps, further preferably 1–15 cps. The quantity of the ink to be filled in the ink cartridge, may be properly determined by one skilled in the art. From the standpoint of providing the negative pressure immediately after the ink cartridge is opened, the ink may be filled to the volume limit of the ink containing portion. However, the quantity of the ink in the negative pressure generating material preferably does not exceed the ink retaining limit thereof. Here, the ink retaining limit is a limit of ink quantity which can be retained by the negative pressure generating material itself.

In the case of an ink cartridge having a hermetically sealed ink containing portion, upon ambient condition Change (temperature increase or pressure decrease) with the cartridge loaded in the ink jet recording apparatus, the ink in the ink chamber is discharged outwardly due to the expansions of the air or ink in the ink containing portion with the possible result of ink leakage.

Therefore, it is preferable in the ink cartridge that volume of expansion of the air (including expansion of the ink although it is small) of the sealed ink accommodating portion upon a worst ambient condition change and that the displacement of the ink from the ink containing portion is allotted to the negative pressure generating material. However, in this case, the absorbing material in the accommodating portion is to be such that it is uniformly compressed without gap between the internal wall surface of the container or that the absorbing material is not creased or burred. If this is not sufficient, the possibility of the ink leakage will be increased.

However, as will be described hereinafter, by sealingly bonding the ink supply pipe and the press-contact member, in case that the ink is going to discharge due to the increase of the internal pressure of the container in the worst ambient condition change, the ink does not discharge to the outside because the small gap in the joint portion is sealed by the bonding agent or the sealing material. Therefore, the above described requirement to the replacement of the absorbing material is eased. This permits a reliable ink jet recording head unit to be provided.

The position of the air vent is properly determined by one skilled in the art, if it is above the opening of the negative pressure generating material accommodating portion. From the standpoint of separating the flow of the ink in the negative pressure generating material upon ambient condition change from the opening, it is preferably remote from the opening. The number, configuration and size of the air vent or air vents, are properly determined by one skilled in the art in consideration of evaporation of the ink. From the standpoint of the evaporation of the ink, the smeller is better.

During transportation of the ink cartridge itself, it is preferable that the opening and/or the air vent are sealed by a sealing member to avoid ink evaporation or air expansion in the ink cartridge. As for the sealing member, a barrier (so-called in the field of package) is used as a single layer and a multi-layer or with taper or cloth. Additionally, aluminum foil is also used. It is also preferable that the same or similar material of the body of the ink cartridge is used as a bonding layer for the barrier, and heat is used for the bonding to improve the hermetical sealing property.

In order to suppress the ink evaporation from the cartridge or the air introduction from the outside thereof, it is effective that the air is removed from the package after the ink cartridge is placed therein, and thereafter, the hermetical sealing is effected. It is preferable that the package material is selected from the barrier as in the case of the sealing material in consideration of the transmissibility for the liquid or gas.

By selecting such package, when the ink cartridge itself is transported, the ink leakage is prevented, and therefore, the reliability is improved.

The material of the body of the ink cartridge may be a known one. However, the material is so selected that it does not adversely affect the ink, or the cartridge is treated with a material not influential to the ink. It is also desirable that the productivity of the ink cartridge is considered. For example, a bottom part 6011 of the main body of the ink cartridge and an upper part are separably molded from resin material. After placing the negative pressure generating member, the bottom part 6011 and the top part are fused together to constitute an ink cartridge body. If the resin material is transparent or semitransparent, the ink in the ink containing portion can be observed, and therefore, the operator can predict when the ink cartridge is to be replaced. For easy fusing with the sealing member, the container is provided with a projection. The other surface of the ink cartridge may be wrinkled.

For the filling of the ink, pressurizing or suction method are usable. Provision of an ink filling opening, in the main body of the container is preferable since then the other openings are not contaminated during the ink filling operation. The ink filling port may be plugged with plastic or metal plug.

The other structure and the configuration of the replaceable ink cartridge may be modified without departing from the present invention.

The advantageous effects of the abovedescribed embodiments are summarized as follows:

By joint-free structure:

(1) Container can be easily replaced.

(2) The load applied to the recording head is small so that the head position is not changed.

(3) The alignment between the joint opening of the container and the head joint is not so strict that the yield of the parts is improved, and the cost can be reduced.

(4) The accuracy of guiding of the ink container by the carriage may be rough, and therefore, the yield of parts is improved, and the cost can be reduced.

The ink jet recording head is fixed at an adjusted position in the apparatus for recording characters and images, and therefore, any external force which may influence the position of the recording head is desirably avoided. This is particularly so when a plurality of ink jet recording heads are fixed as in a color image forming apparatus.

According to the embodiments, the external force by abutment of the ink cartridge main body to the ink supply tube 2200 as the joint portion of the recording head upon the mounting or replacement of the ink cartridge, can be avoided Namely, the force other than that required for urging the negative pressure generating member in the cartridge can be avoided.

Particularly, a recording head unit comprising a plurality of ink jet recording heads is usable for color image formation. In this case, strict accuracy are required for the respective head positions. If even one of the heads is deviated, the quality of the color image is remarkably deteriorated. Therefore, upon the use of the replaceable ink cartridge of this invention for such an ink jet recording head unit, the force exerted to the recording head should be minimized during the mounting or demounting operation or during the use of the apparatus.

When the ink cartridge is kept loaded in the recording apparatus for a long period of time, there is a liability that the ink is evaporated through the gap between the jointing portion of the recording head and the opening of the ink cartridge. However, according to the embodiments, the evaporation of the ink can be sufficiently suppressed by the easy press-contact connection.

Referring to FIGS. 12–13, the description will be made as to another embodiment of the replaceable ink cartridge.

FIGS. 12 and 13 are sectional views of major portions of interconnection structure between the replaceable ink cartridge 6000 and an ink jet recording head.

Figure 12A:
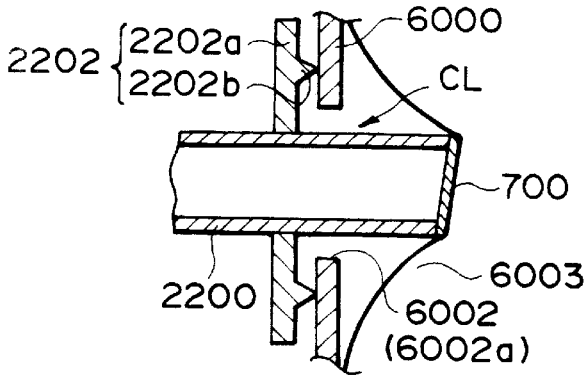
FIGS. 12A, 12B, 12C, 12D and 12E are sectional views illustrating coupling between an exchangeable ink cartridge and an ink jet recording head, in a further example.

In FIG. 12A, a simple press-contact member 2202 is used in a part of an outer peripheral surface 2202*a* of the ink supply pipe of a cylindrical shape of an ink jet recording head IJU. The press-contact member 2202 is projected radially outwardly from the ink supply pipe 2200. One side thereof is provided with a plate portion 2202*a* contactable with a head fixing wall 2201 of the recording head IJU, and a rib 2202*b* having a triangular cross-section projecting in a direction of a length of the ink supply pipe 2200 at the other side of the plate portion 2202*a*. Both of then are made of a material having a lower hardness than the material constituting the ink cartridge 6000 and the recording head IJU. Upon the interconnection therebetween, the rib 2202*b* is abutted to a neighborhood of the opening 6002 of the outer wall of the ink cartridge 6000.

By employing the structure shown in FIG. 12A as the simple press-contact member 2202, the external force upon the mounting of the ink cartridge 6000 is only the force urging the negative pressure generating member 6003. After the completion of the mounting, there exist only a light contact between the rib 2202*b* and the outer wall of the cartridge 6000, so that a small external force is imparted in a horizontal direction in the Figure. Accordingly, the force imparted to the recording head during the cartridge mounting operation is the force required to press the negative pressure generating material 6003 and the force of contact. By adjusting the degree of pressing, the force can be substantially adjusted.

The press contact member 2202 may be contacted to the outer wall of the ink cartridge with a small force. Even if there is small local gap therebetween, the ink evaporation can be suppressed, and therefore, there is no problem. In addition, even if the air is introduced into the cartridge, the performance of the ink cartridge is not deteriorated, as will be described hereinafter.

Figure 12D:
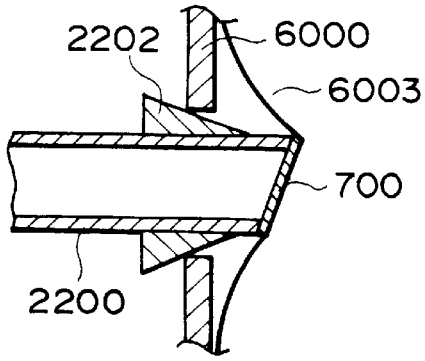
Figure 12B:
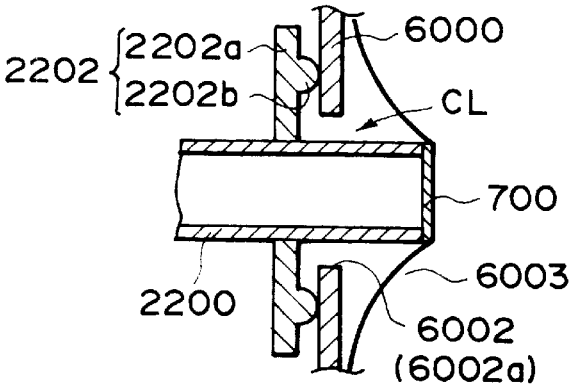
Figure 12E:
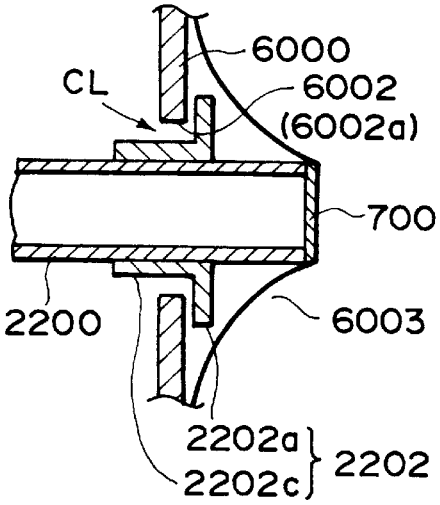
Figure 12C:
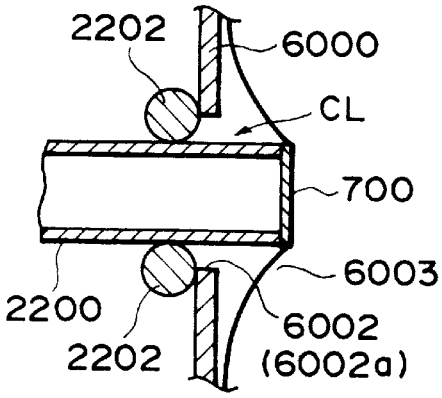

In this embodiment, the interconnection between the ink cartridge and the ink jet recording head, is established in the manner shown in FIG. 12A. However, as mentioned hereinbefore, the structure is not limited to this. FIGS. 12B–12D are modifications of FIG. 12A structure. In FIG. 12B, the rib 2202*b* of the simple press-contact member 2202 has a circular cross-section., generally it is in the form of a ring. In FIG. 12C, the simple contact member 2202 itself has a circular cross-section, generally in the form of a doughnut. In FIG. 12D. the simple press-contact member 2202 itself has a triangular cross-section (generally conical). The diameter decreases toward the end of the ink supply pipe 2202, so that it is inserted into the gap CL between the inner edge of the opening 6002 and the outer surface Cf the ink supply pipe 2202, and the outer surface of the simple press-contact member 2202 is contacted to the inner edge of the opening 6002. In FIG. 12E, simple press-contact member 2202 having an L cross-section is disposed to the outer periphery of the ink. supply pipe 2200. The simple press-contact member 2202 is constituted by a plate portion 2202*a* projecting radially outwardly from the ink Supply pipe 2202 and a cylindrical portion 2202*c* extending rearwardly from the Plate portion 2202*a* and fixed to the outer surface of the ink supply pipe at the internal periphery. They are made of a relatively soft material than the material constituting the ink cartridge 6000 and the recording head IJU, In this example, when the ink supply pipe 2200 is inserted into the opening 6002, the plate portion 2202*a* of the simple press-contact member 2202 advances over the inner edge of the opening 6002 while being deformed, until the ink supply pipe 2200 is engaged into the opening 6002 by the plate 2202*a*. The engagement is establish by the deformation of the plate portion 2202*a* of the simple press-contact member 2202, and therefore, the removal is also easy. However, in consideration of the load applied to the recording head upon the interconnection, examples shown in FIGS. 12A–12C are preferable.

As for other examples, the press-contact member may be provided in the ink cartridge 6000 not in the ink jet recording head IJU. A simple press-contact member having the similar structure as the simple press-contact member 2202 shown in FIG. 12A may be fixed on the outer wall of the ink cartridge. The top of the projection is abutted to the fixing wall of the ink jet recording head IJU. The press-contact member shown in FIG. 12B may be fixed on the inner edge of the opening 6002.

As for the other interconnection structure, as shown in FIGS. 13A–13D, the deformations and changes of both of the ink cartridge 6000 and the recording head IJU, may be employed.

Figure 13A:
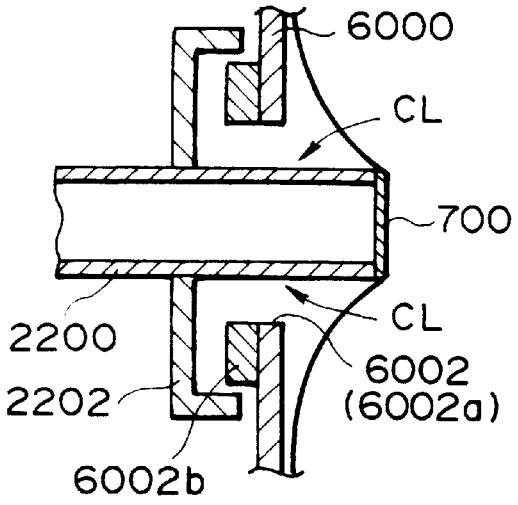
FIGS. 13A, 13B, 13C and 13D are sectional views illustrating coupling between an exchangeable ink cartridge and an ink jet recording head in a further example.
Figure 13C:
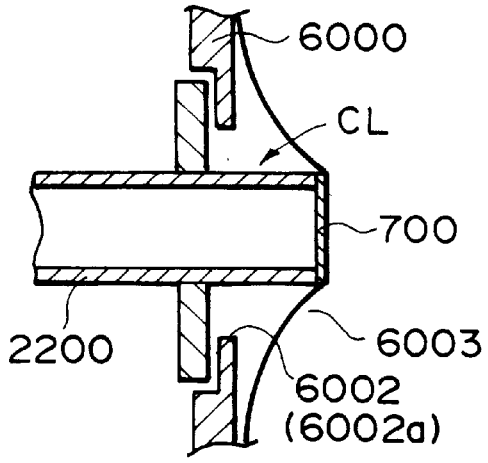
Figure 13B:
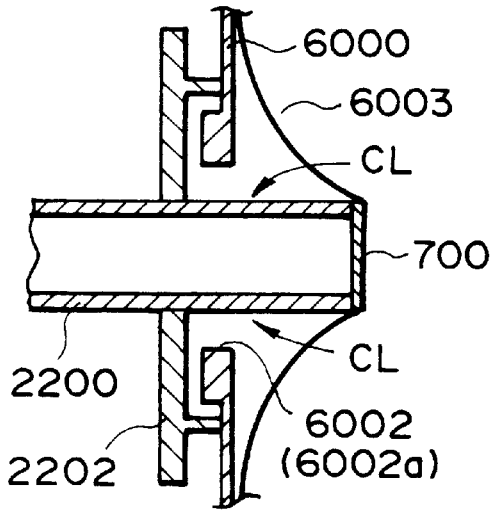
Figure 13D:
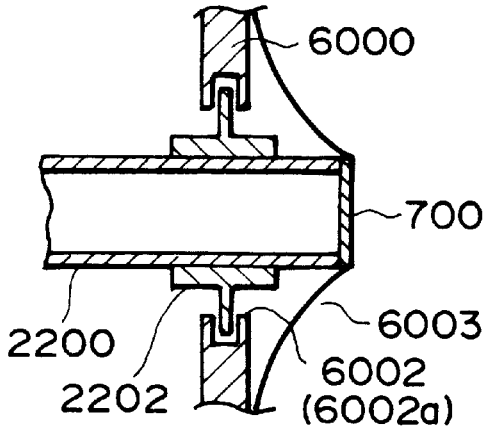

In FIG. 13A, a wall 6002*b* is made of a material softer than the ink cartridge 6000 and the recording head IJU and is disposed at an outer edge of the opening 6002, and a simple press-contact member 2202 comprises a disk extending radially outwardly from the ink supply pipe 2200 at the outer periphery of the ink supply pipe 2200 and a cylindrical portion extending frontwardly along the length of the ink supply pipe 2200 from the outermost edge of the disk. The front edge of the cylindrical portion of the press-contact member 2202 is abutted to the outside of the wall 6002*b* around the opening 6002 of the cartridge 6000 upon the mounting of the cartridge. In FIG. 13B, the wall 6002*b* is such that the wall of the cartridge 6000 adjacent the opening 6002 as a small thickness except for the peripheral edge of the opening 6002, and that a member similar to that show in FIG. 13A is used. In FIG. 13C, unlike FIG. 13B example, only the edge portion of the opening 6002 has a small thickness. To the cut-away portion provided thereby, an edge portion of the press-contact member 2202 in the form of a disk extending radially outwardly from the outer periphery of the ink supply pipe 2200, is engaged. In FIG. 13D, a cut-away portion is formed in the central portion of the inside surface 6002*a* of the opening 6002 among the constituent walls of the cartridge 6000. To the cut-away portion, a part of the press-contact member 2202 provided on the outer periphery of the ink supply pipe 2200 is engaged. Namely, the simple press-contact member 2202 of this example comprises a cylindrical portion fixed to the outer periphery of the ink supply pipe 2200 and a disk extending radially outwardly from the outer central portion of the cylindrical portion, so that the outer edge portion of the disk is engaged to the cut-away portion.

The material constituting the simple press-contact member as a separate member and the peripheral portion of the opening, it may be the same material as the ink cartridge 6000 and the recording head IJU. However, in order to reduce the force exerted to the recording head upon the press-contact, the material may preferably have small hardness than the material constituting the ink cartridge 6000 and the recording head IJU.

As for the material constituting the separate simple press-contact member, it may preferably exhibit low gas transmissivity to suppress the ink evaporation. When a separate simple press-contact member is used in the joint portion between the cartridge 6000 and the recording head IJU, it may be mounted to the ink cartridge 6000 or to the recording head unit IJU before the interconnection therebetween. The configuration and dimension may be properly determined by one skilled in the art in consideration of the configuration and dimension of the ink cartridge 6000 and/or the recording head IJU. When a separate simple press-contact member is mounted to the ink supply pipe 2200 of the recording head IJU, it is not necessary to fix it, but movable structure is desirable.

The structure shown in FIG. 5 is one of the suitable ink container usable with this embodiment because there is provided a gap between the opening 6002 and the supply pipe 2200. By doing so, no such a force as is influential to the positional precision of the recording head, is not applied to the insertion of the ink container. This advantageous effect is not deteriorated even if the simple press-contact member as shown in FIGS. 12A–12E or FIGS. 13A–13D are used, or ink absorbing material as shown in FIGS. 9 and 11 are used. In addition, the problem of the ink evaporation or ink leakage can be reduced.

Figure 14:
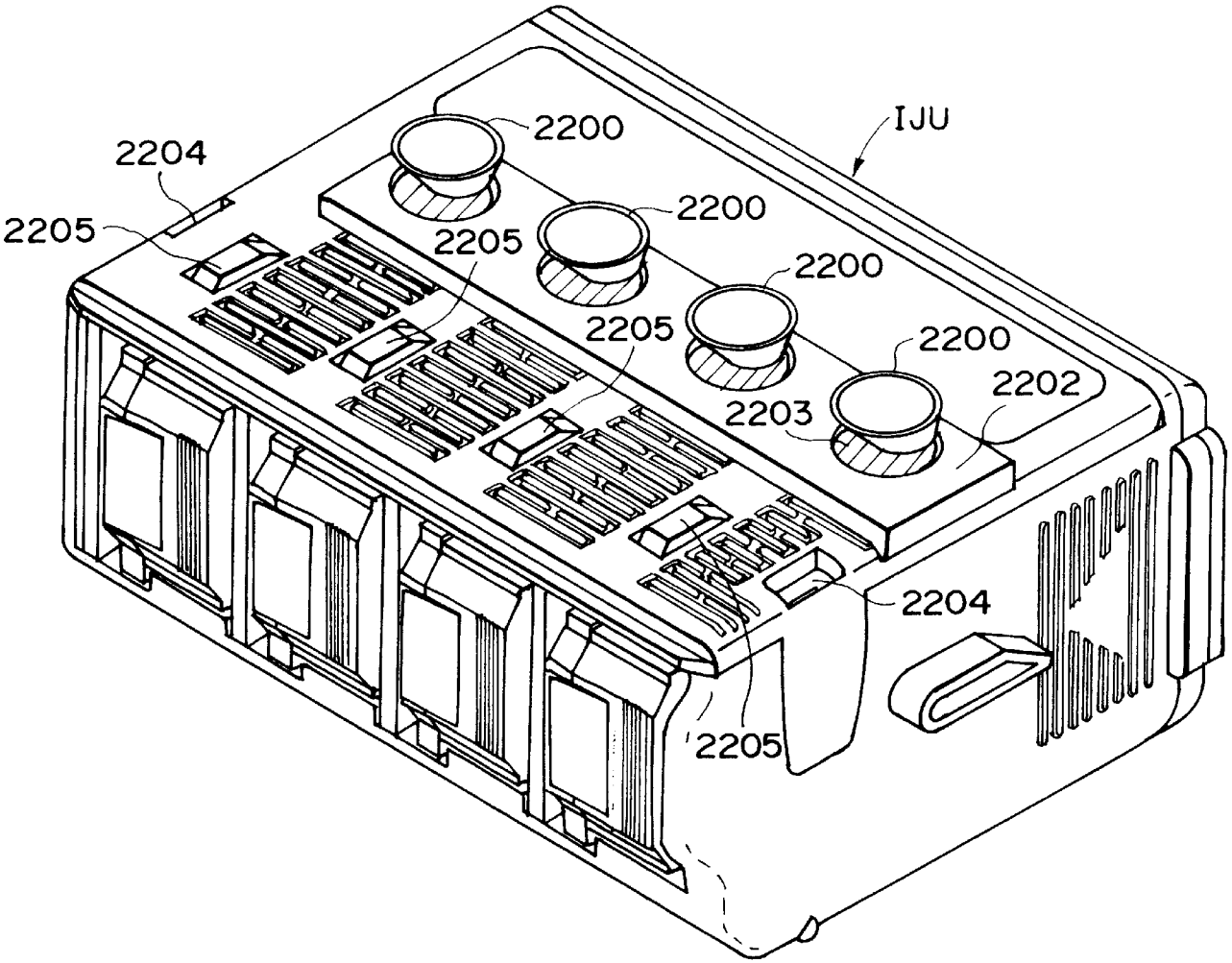
FIG. 14 is a perspective view of an ink jet, recording head unit according to a further embodiment of the present invention.

Referring to FIG. 14, there is shown an outer appearance of a preferable ink jet head unit, in a perspective view, according to a further embodiment of the present invention. In this embodiment, the press contact member 2202 of the ink jet recording head unit IJU is integral with a base portion of four ink supply pipes 2200 arranged in one line on one side wall of the unit IJU. Each of the ink supply pipe 2200 is in the form of a horn having a reduced diameter at the base side as compared with the free end side. Adjacent the reduced portion, there is bonded a sealing material 2203 for connecting the ink container 6000 and the unit IJU with the opening 6002 being sealed, when an ink supply pipe 2200 (joint portion) is inserted into the opening 6002 of the ink container 6000 of a replaceable type. In the side wall of the unit IJU, a recess 2204 and a projection 2205 for the correct positioning for the interconnection. In the opposite wall, a positioning recess is formed to position by abutment to a positioning projection HCl of the head carriage HC. This is not shown in FIG. 14, but is shown in FIG. 15.

FIG. 5 is a partial sectional view of a major portion of a recording apparatus having a head carriage HC on which the ink jet recording head unit IJU shown in FIG. 14 is mounted. In FIG. 15, the ink container 6000 is mounted to the unit IJU positioned and fixed by abutment between the projection HCl of the head carriage HC and the positioning recess, and is carried on the head carriage HC. The structure of the portion of the head carriage HC on which the ink container 6000 is carried, will be described in detail. It comprises a mounting portion HC2 which is generally flat, and a projected portion HC3 projected upwardly adjacent an end of the head carriage HC, in the Figure. At an upper portion of the projection HC3, a slope HC4 lowering toward. the light is formed. The projection HC3 is effective to urge the wall opposite from that having an opening 6002 of the ink container 6000, which will be described hereinafter, for the purpose of firmly connecting the ink container 6000 to the unit IJU. When the ink container 6000 is mounted to the head carriage, the ink supply pipe 2200 of the unit IJU is inserted into the opening 6002 of the container 6000, and thereafter, the ink container 6000 is pushed toward the unit IJU so that the bottom corner of the ink container 6000 slides on the slope HC4 of the head carriage HC, thus lowering in the container 6000. By doing so, the ink container 6000 can be assuredly fixed, and in addition, the opening 6002 can be sealed with certainty.

Figure 15:
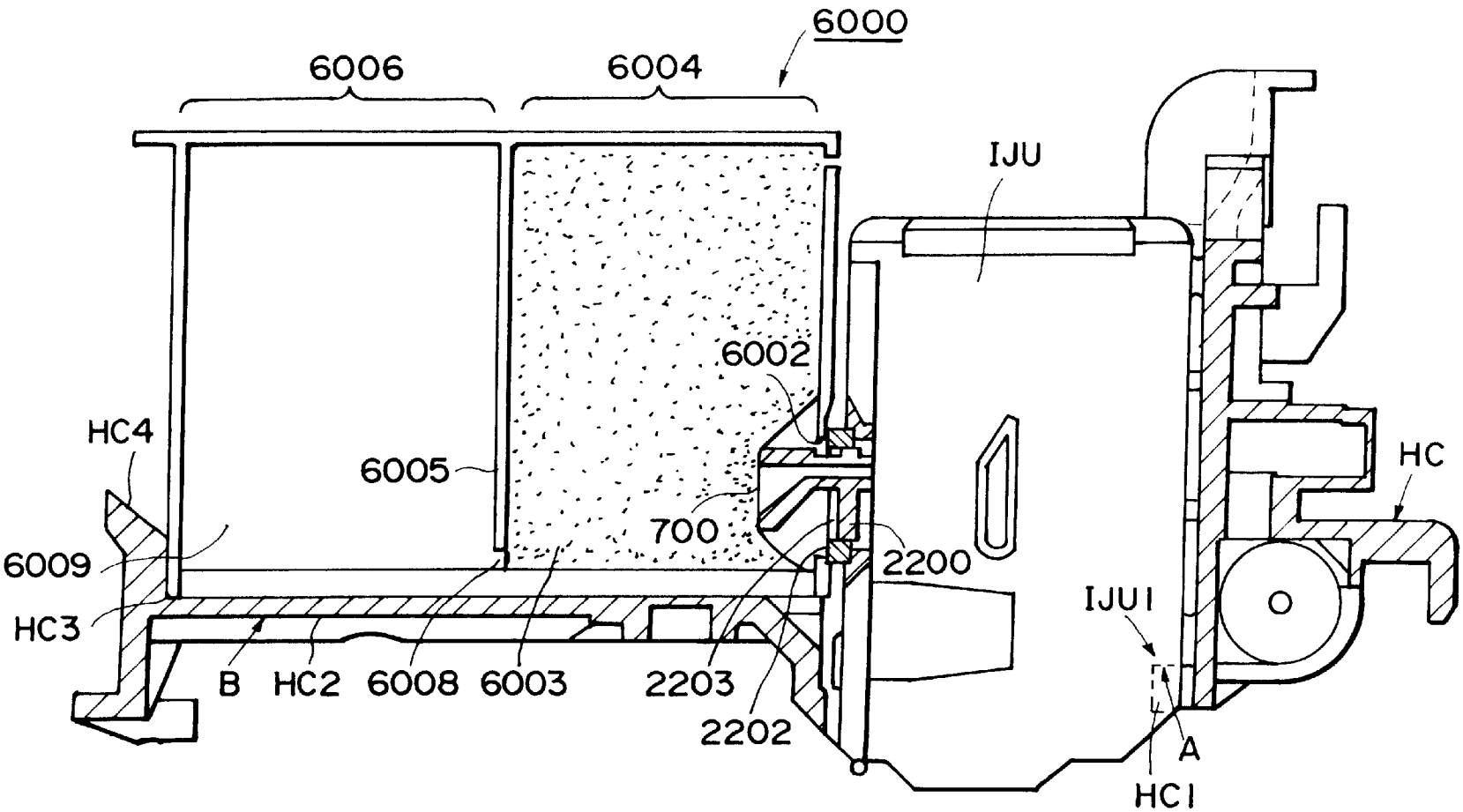
FIG. 15 is a partial sectional view of a recording apparatus in which an ink jet recording head unit of FIG. 14 is mounted on a head carriage.

In this; embodiment, as shown in FIG. 15, a step formed between the ink supply pipe 2200 and the press-contact member 2202 to facilitate application of the bonding sealing material 2203. Depending on the method of application, the step is not necessary.

By using the structure of the above embodiment, the advantageous effects can be provided in synergism.

The description will be made as to a preferred modification of the ink container and the operation common to the above ink container will be described.

As for a mechanism for interconnection between the ink jet head and the ink cartridge, a sealing member 2202 (press contact member of FIG. 15) is interposed between the ink container and the ink jet head It is preferable that the deformable sealing member 2202 is deformed to assure the prevention of the leakage of the liquid to the outside. When a gap is formed in the ink container adjacent the opening when the supply pipe of the head is inserted into the ink container, the material preferably exhibits slight gas transmissivity when the pressure is higher than the atmospheric pressure. This is because the inside pressure of the container increases as a result of the ambient condition change, the tendency of the pressurized ink concentrating to the air vent is eased by the gas transmissivity, by which the motion of the ink to the ink supply pipe is promoted.

By locating the ink supply opening or the compressed or compressible region of the negative pressure generating material (by the supply pipe) adjacent a side faced to a partition wall constituting a fine communicating portion, substantially stabilized ink supply path is assuredly constituted in the vacuum generating material in a second accommodating chamber. As for a structure for further stabilizing this, the ink supply opening is located above the fine communicating portion with respect to a bottom surface of the ink cartridge, by which the above-described gas transmissivity of the sealing member 2202 functions as a normal gas penetration preventing member, and therefore, the gas-liquid interchange in the hermetical sealed structure of a second accommodation chamber is further stabilized. By this, the ink supply in the compressed region of the absorbing material is assured. From this standpoint, the gas transmissivity of the sealing member 2702 may be a complete gas-sealing property.

Here, the supply pipe also includes a valve structure or another connecting member of a cartridge effective to compress the negative pressure generating material.

The consideration has been made to the condition of the usable ink. When the ink surface tension exceeds 55 dyne/cm (25° C.), the ink change due to the ambience dependency of the ink or the internal structure is remarkable, but if it is not more than 55 dyne/cm, this problem is significantly avoided. Particularly, if it is not more than 50 dyne/cm, very stabilized properties is exhibited without being influenced by the ambience. In addition, if it is not less than 55 dyne/cm, the ink assuredly moves in the negative pressure generating material. Particularly in the case that an interface is formed between the air and the ink in the negative pressure generating material, the interface can be stabilized for a long period of time. In a cartridge in which the liquid-air exchanging zone extends from the fine communicating portion to the portion faced to the negative pressure generating material in the first accommodating chamber, a linear interface can be stably formed, and therefore, it is preferable. On the other hand, if the surface tension of the ink is lower than 20 dyne/cm (25° C.), the ink does not leak in the normal use, but if some impact is applied, the ink leakage occurs. If the surface tension is not less than 20 dyne/cm, the ink leakage can be prevented even in the case of the impact. Particularly, when the surface tension is not less than 25 dyne/cm and not more than 50 dyne/cm, the very stabilized condition is maintained without being influenced by the ambience.

The description will be made as to a preferable structure of the negative pressure chamber of the ink cartridge having the structure shown in FIGS. 4–15.

Figure 16:
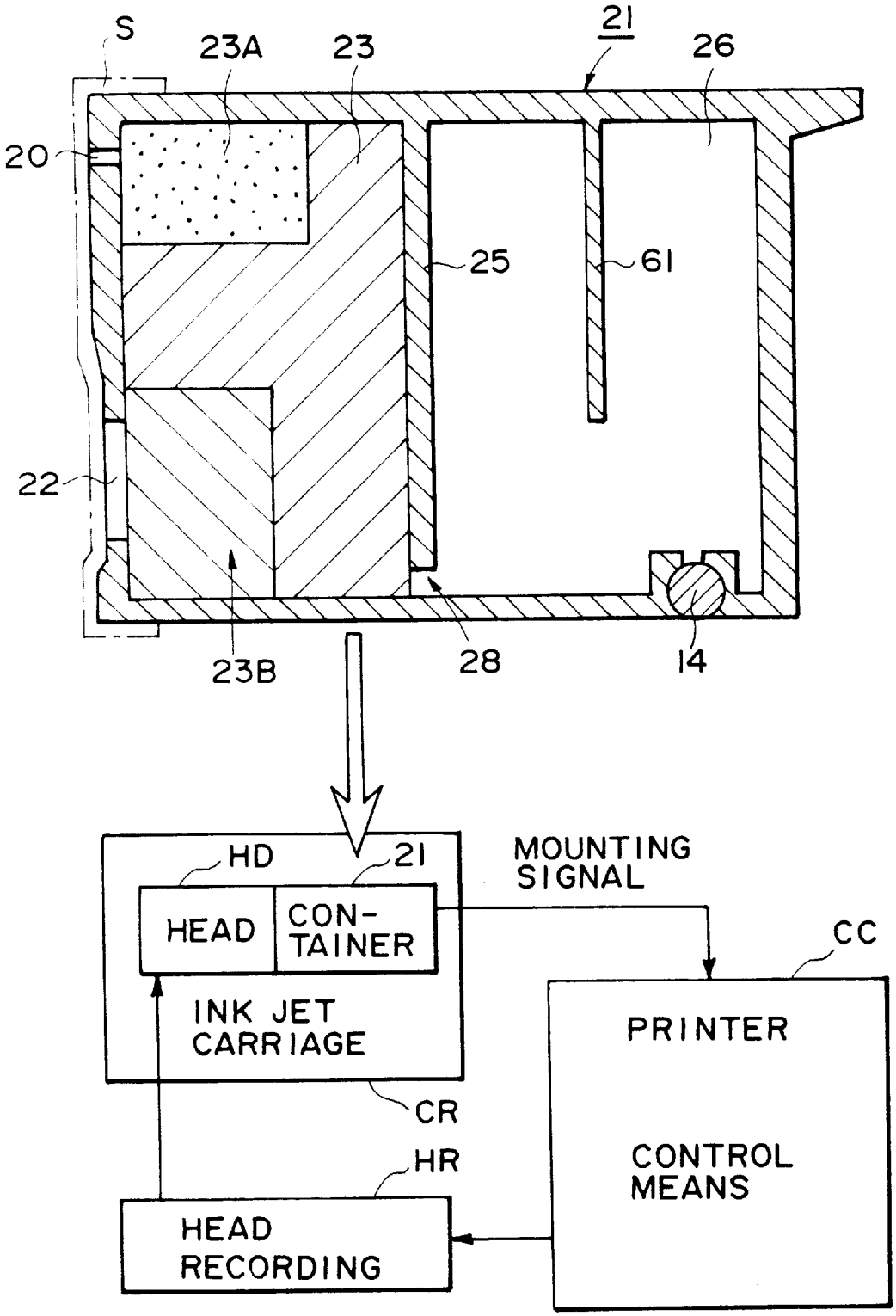
FIG. 16 illustrates an ink jet printer using an ink jet cartridge according to an embodiment of the present invention.

As shown in FIG. 16, the negative pressure generating material adjacent the air vent is not supplied with the ink, and therefore, does not retain the ink therein. Then, the opening 13 is sealed by a ball 14, and the opening 22 and the air vent are sealed by a single sealing member S (different sealing members are usable). FIG. 16 shows an ink jet cartridge before use. In this Figure, an ink is contained in the ink accommodating chamber 6. Figure illustrates a hermetically sealed ink jet cartridge 21, and a printer usable therewith. The cartridge 1 is provided with a negative pressure generating zone 23A adjacent the air vent 20 as a non-ink-retaining zone at a top corner of the cartridge. The negative pressure generating zone 23B below the zone 23A is a compressible zone which can be compressed by insertion of an unshown ink supply pipe. The portion of the negative pressure generating material other than the zones 23A and 23B retain the ink and is free of external influence. The zone 23B is faced to an opening 22 for permitting connection with the ink supply tube, the opening 22 being formed in the same side and below the air vent 20. The opening 22 is located above the fine communicating portion 28, and the above-described structural features are used.

The cartridge 21 of FIG. 16 becomes usable if the above-described sealing member S is removed. However, since the zone 23A does not retain the ink, the ink does not leak out even if vibration or pressure change occurs in the unsealing operation.

This embodiment employs a non-ink retaining zone adjacent the air vent in the negative pressure generating material irrespective of the state of keeping or state of use of the ink cartridge. By doing so, the ink is prevented from leaking out of the ink cartridge through the air vent against ambient condition change. Particularly when, the sealing member seals the air vent, the sealing member is prevented from peeled off. Particularly when the sealing member seals the air vent, the sealing member is prevented from unintended removal. During use, this region is effective to efficiently supply the amount of air corresponding to the necessity, and in addition is effective to suppress the negative pressure change in the ink jet cartridge. If the zone adjacent the air vent is completely free of wet with the ink, it is preferable from the standpoint of reducing the ink seeping speed, but it is first wetted with the ink, and thereafter, the ink is removed from the zone.

According to this embodiment, the ink supply opening or the compression or compressible zone is located at a side opposite from the partition wall constituting the fine communicating portion, and therefore, the ink supply path can be stably assured in the negative pressure generating material in the second accommodating chamber. This can be further assured by locating the ink supply opening above the fine communicating portion with respect to the bottom surface of the ink cartridge. This positional feature is effective to make a substantial ink moving direction constant, so that all of the ink in the second accommodating chamber can be used up. After it is used up, the air in the second accommodating chamber moves toward the opening, and as a result, the ink in the negative pressure generating material can be used up, thus reducing an amount of non-usable remaining ink.

By locating a non-compressed zone (not compressed by the supply pipe) and the compressed zone (by the supply pipe) of the negative pressure generating material in this order from the partition wall constituting the fine communicating portion to the opposite wall, the above-described one directional ink supply path can be formed in the non-compressed zone, and in addition, by the ink retaining power in the compressed zone, the non-usable ink is further reduced.

The ink jet printer of this embodiment, as shown in FIG. 16, is provided with head recovery means HR for recovering the recording head by sucking or ejection using sucking means the ink through the recording head from the cartridge, automatically or manually. By doing so, the state of the ink in the negative pressure generating means can be corrected before printing, and therefore, the above-described function of the cartridge can be provided without being influenced by the state of keeping the cartridge.

The container 21 mounted to the ink jet head HB carried on a scanning type carriage CR corresponds to the above-described cartridge 1 but without the sealing tape. The ink supply pipe of the head compresses and deforms the compressible zone 23B of the negative pressure generating material 23 through the opening 22. In this embodiment, the negative pressure generating material 23 is deformed toward the fine communication portion. At this time, mount detecting means (mechanical or electrical, not shown) transmits the cartridge mount signal LP to printer control means CC. In response thereto, the recovery means HR is operated before start of the recording operation, thus discharging the ink in the container 21 to improve the state of the ink in the container.

Figure 17A:
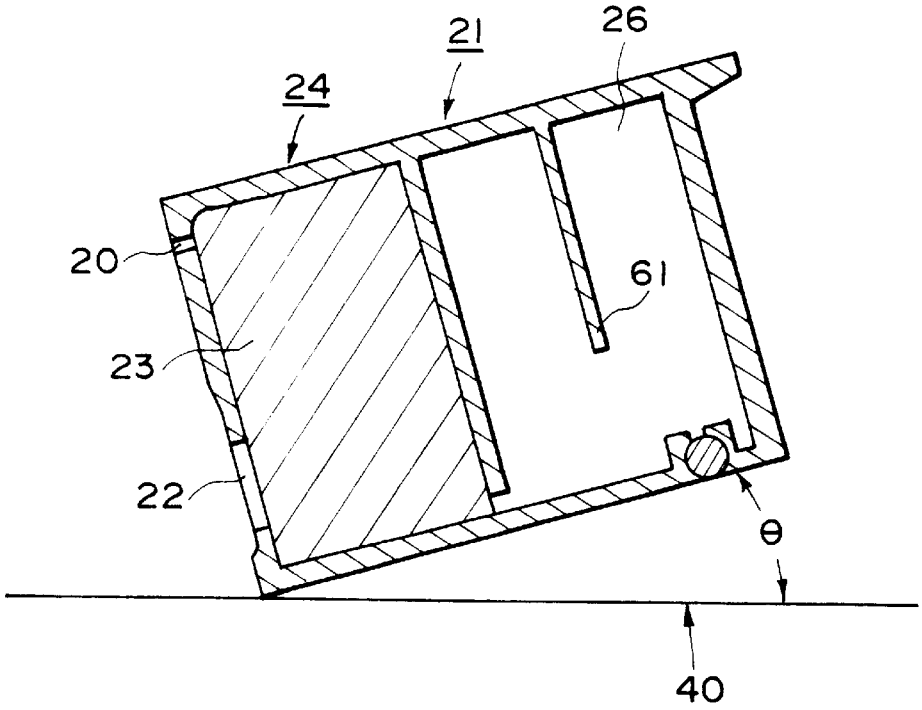
FIGS. 17A and 17B are sectional views illustrating a permissible range of inclination when the ink cartridge is being used.
Figure 17B:
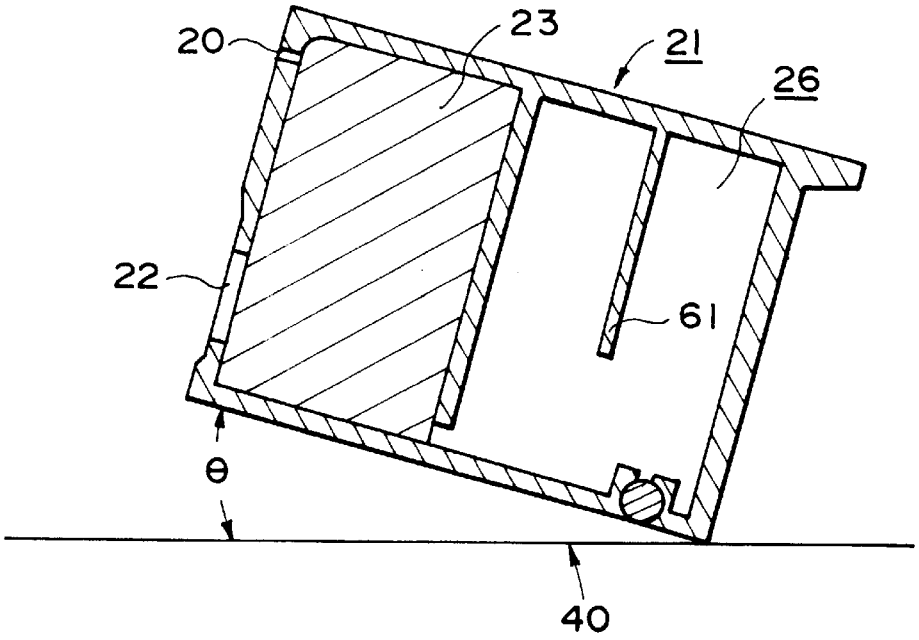

FIGS. 17A and 17B illustrate an inclinable range in the printing operation or in the ink supplying operation. Designated by a reference numeral 40 is a horizontal plane. It is preferable for the present invention that the fine communicating portion is located at a lower position. Ideally, it is parallel al a bottom surface of the cartridge with the horizontal plane 40. Practically, however, in the case of the two chamber structure, the angle formed between the horizontal plane and the cartridge bottom surface $\theta$ may be $0 \leqq \theta \leqq 15$ degrees without practical problem. When it is moved by the scanning type carriage, $0 \leqq \theta \leqq 5$ degrees is preferable. Even if the inclination or the cartridge occurs due to an unexpected factor, the provision of the gap between the ink supply pipe 2200 and the opening 6002 of the ink cartridge permits easy joint without excessive load to the recording head, and therefore, the ink supply performance is assured.

A plurality of negative pressure generating material is usable. However, the air can move in the interface therebetween, and therefore, it is preferably a single porous material.

If the ink containing chamber contains a larger quantity of the ink than the negative pressure generating material accommodating chamber, it can be included as an ink containing chamber, in effect.

Referring to FIG. 18, the description will be made as to the ink consumption mode in the ink cartridge.

Figure 18A:
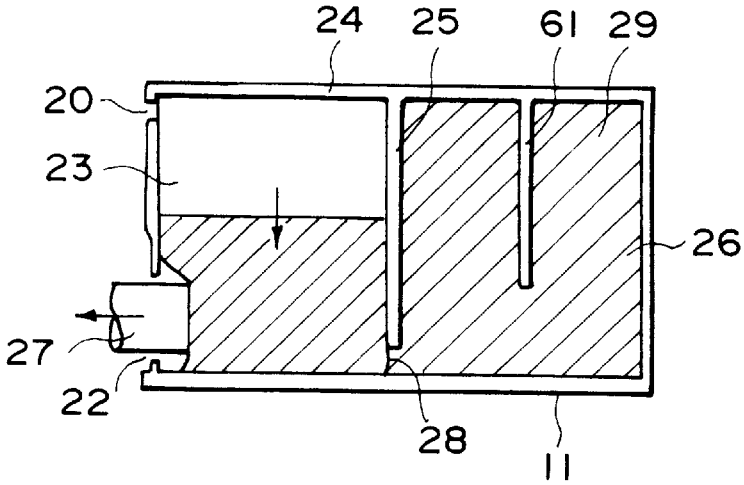
FIGS. 18A, 18B and 18C illustrate changes during printing operations.
Figure 18B:
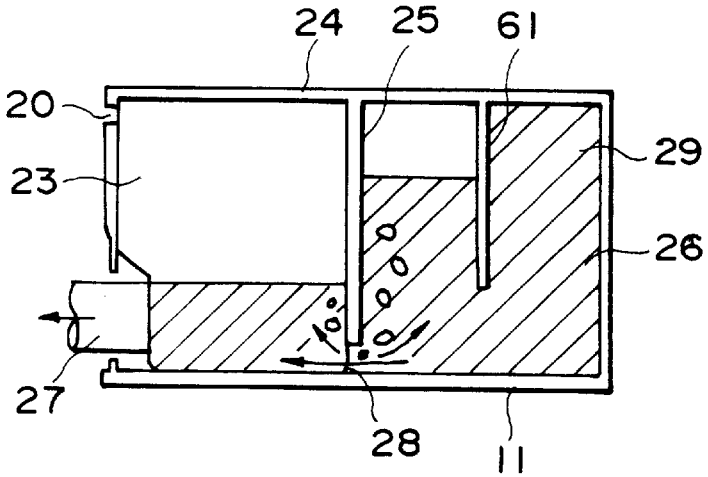
Figure 18C:
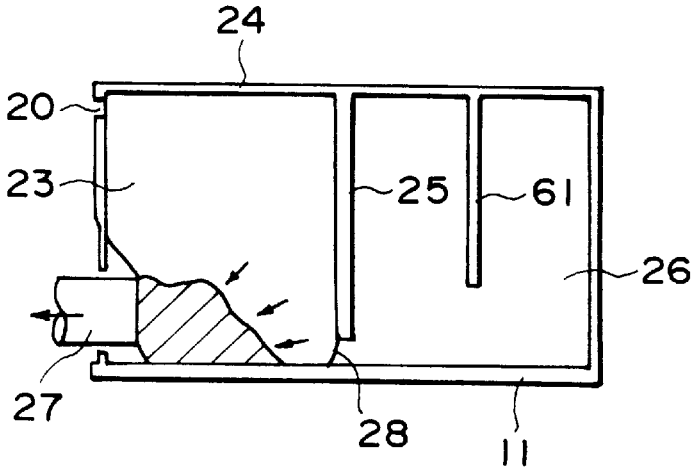

In FIG. 18A, ink joint member 27 as the ink supply pipe is inserted into the opening 22 of the main body 21 of the ink cartridge to be press-contacted to the negative pressure generating material 23. It is a sectional view in the operable state. It is preferable that a filter is provided at an end of the joint member 27 to remove the foreign material in the ink cartridge. When the ink jet recording material is operated, the ink is elected through the orifices of the ink jet recording-head, so that ink sucking tendency is produced in the ink container. By this, the ink is moved to the negative pressure generating material accommodating portion 24 from the ink containing portion 26 through a yap between an end of the rib 25 and a bottom 11 of the ink cartridge, and is supplied to the ink jet recording head through the negative pressure generating material 23 and the joint member 27. By this, the pressure in the ink accommodating portion 26 which is sealed except for the gap 28 reduces with the result of pressure difference between the ink accommodating portion 26 and the negative pressure generating material accommodating portion 24. With the continuous of the recording operation, the pressure difference continues to increase. However, since the negative pressure generating material accommodating portion 24 is opened to the ambience through the air vent 28, and therefore, the air, as shown in FIG. 18B, is introduced into the ink accommodating portion 26 through the negative pressure generating material 23 and through the gap 28 between the rib 25 and the bottom 11 of the ink cartridge. At this point of time, the pressure difference between the ink accommodating portion 26 and the negative pressure generating material accommodating portion 24 is removed. During the ink jet recording operation, this is repeated, so that a substantially constant negative pressure is provided in the ink cartridge. The ink in the ink accommodating portion 26 can be all consumed except for the ink deposited on the internal wall surface of the ink accommodating portion 26, and therefore, the ink use efficiency is improved (FIG. 18C). When the recording operation is not carried out, by the capillary force of the negative pressure generating material 23 itself (or the force of the meniscus at the interface between the ink and the negative pressure generating material), the leakage of the ink from the recording head can be prevented.

The description will be made as to the gas-liquid exchange in the negative pressure generating material accommodating chamber.

Figure 19B:
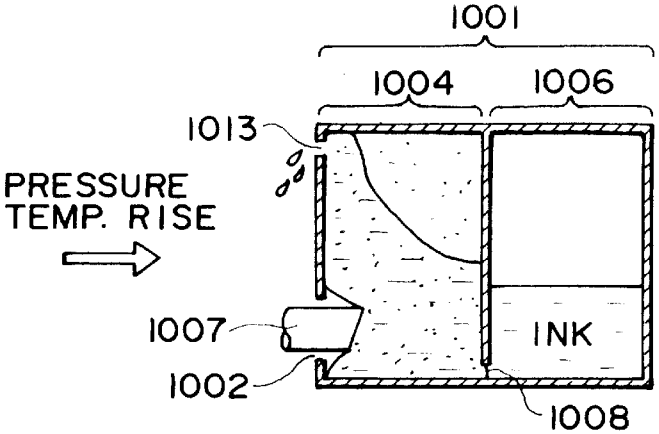
FIGS. 19A, 19B, 19C and 19D illustrate change due to ink level in a first accommodating chamber.
Figure 19A:
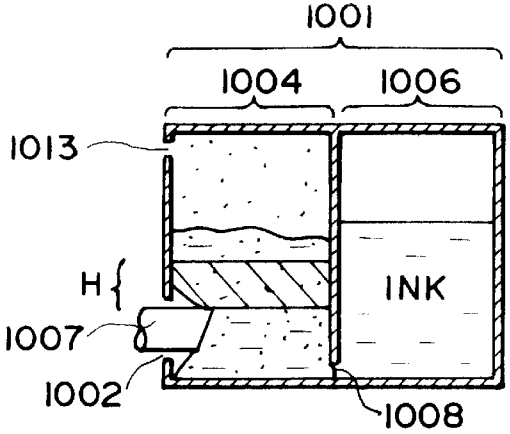

FIGS. 19A–19D illustrate an interrelation between an ink level and an ink leakage from the ink jet cartridge in an example where the air vent is located at an optimum position. When the upper limit of the ink level exceeds the optimum zone H, as shown in FIG. 19A, the ink leaks out through the air vent 1013, as shown in FIG. 19B, when the ambient pressure decreases or temperature increases. Irrespective of the position of the air vent 1013 in the first accommodating chamber 1004 as the vacuum generating material accommodating portion, the ink leaks when the ink level exceeds the optimum zone H. The air vent 1013 of this embodiment, is most remote position from the communicating portion 1008, so that the safety margin is increased.

Figure 19D:
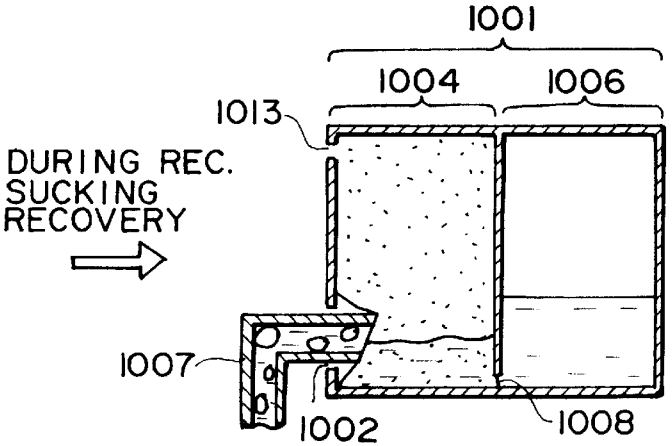
Figure 19C:
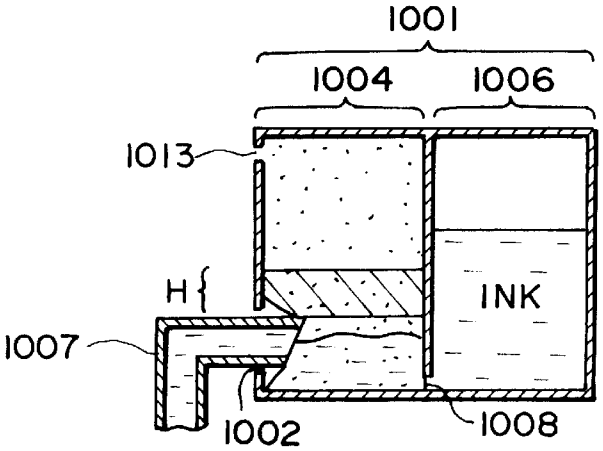

As shown in FIG. 19C, when the ink level is lower than the optimum zone H, an air layer is produced adjacent the joint member 1007 (ink supply pipe) of the inks jet head inserted thereinto, and therefore, when the sucking recovery operation is carried out or when the recording operation is carried out, the air may be introduced into the head through the joint member 1007 as shown in FIG. 19D. If this occurs, the ink flow is impeded with the result of disturbed printing.

The detailed consideration has been made to the optimum zone H of the ink level. The ink level in the cartridge itself before the connection with the joint member is preferably higher than the top end of the ink supply opening, and not higher than the position 5 mm higher than the top end is preferable, since then the above-described inconveniences can be avoided. The lower limit is further 1 mm higher position. In this case, the ink leakage does not occur, and the separate provision of the air vent works well. The investigations have been made as to the ink level after the joint with the ink jet head, including the ink level not satisfying the optimum zone for the cartridge itself. The optimum zone H is a region above the top end of the joint member 1007 inserted through the ink supply opening, and below a position 5 mm higher than the top end, further preferably, it is higher than a position 1 mm higher than the top end of the joint member and below a position 5 mm higher than the top end.

In the case of the liquid level adjustment for the independent cartridge and for the jointed case, one or more of the following methods are usable to adjust the ink level.

(1) A bottom portion of a partition wall for separating a first accommodating chamber as a negative pressure generating material accommodating portion and a second accommodating chamber (ink accommodating chamber) is disposed in the optimum zone H, by which the ink level is substantially horizontal.

(2) Compression ratio of the negative pressure generating material is adjusted to provide vertically different compression ratio, more particularly, the bottom portion is compressed more. This method is particularly effective if used with (1).

(3) The degree of compression or pressing of the negative pressure generating material by the joint member of the ink jet head, is adjusted. For example, when the ink supply rate per unit time is desired to be increased (total ejection quantity of the recording head is increased), the pressure is reduced to increase the ink flow rate (the liquid level is maintained at a higher level by another method). On the other hand, in order to prevent the air introduction with certainty, the pressure is reduced to raise the liquid level adjacent the joint member.

On the other hand, in the ink jet cartridge described above, it is desired that the ink of the second chamber and the air in the first chamber are stably and smoothly exchanged during the ink supply.

The description will be made as to improvement in this respect.

Figure 20A:
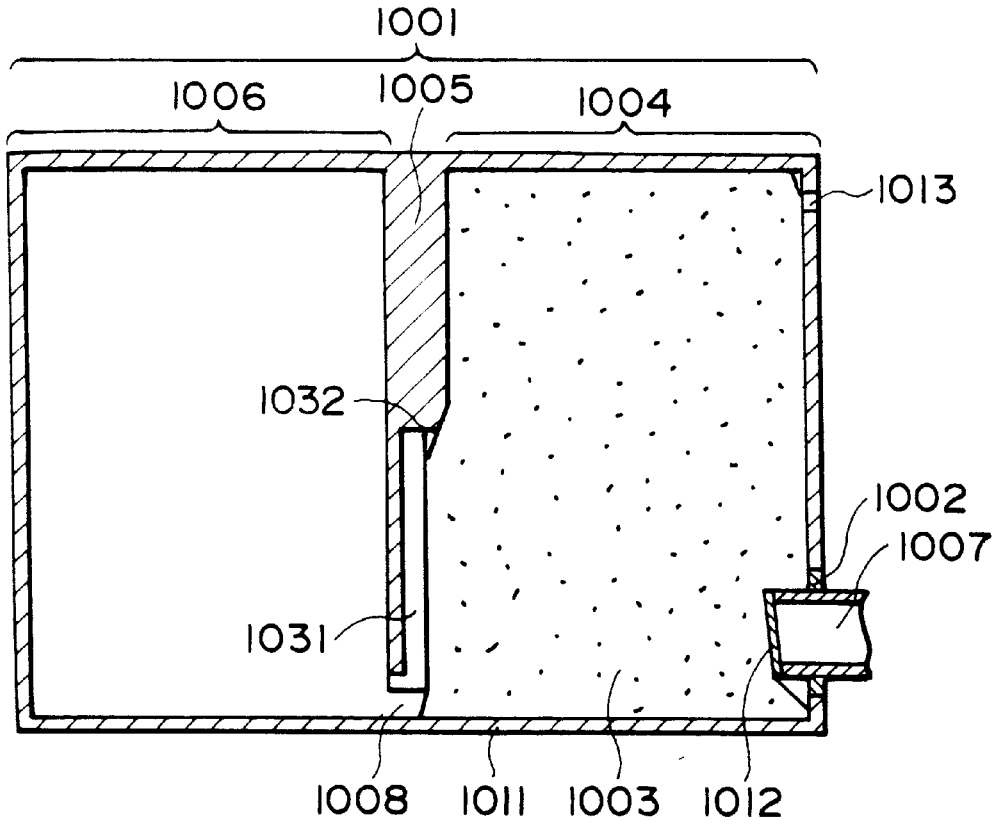
FIG. 20A is a longitudinal sectional view of a main body of an ink cartridge for an ink jet printing according to a further embodiment of the present invention.
Figure 20B:
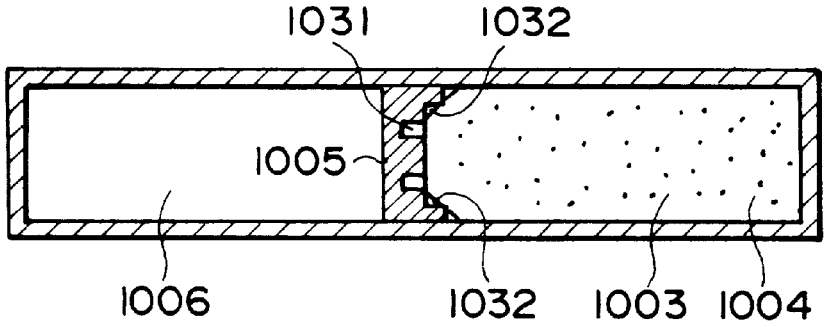
FIG. 20B is a cross-sectional view thereof.
Figure 21:
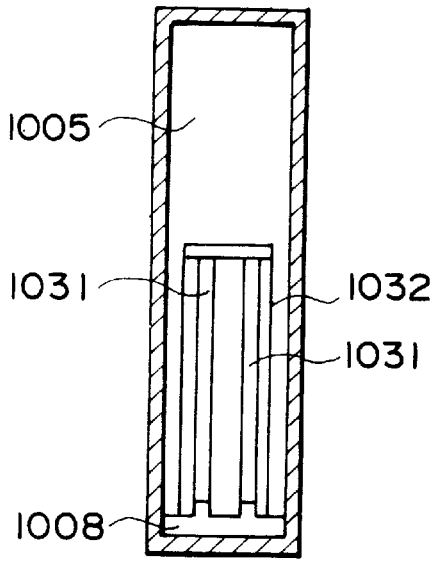
FIG. 21 is a sectional view of a main body of an ink cartridge in which surface of rib is illustrated.

FIG. 20A is a longitudinal sectional view of the main body of the ink jet cartridge according to a further embodiment of the present invention. FIG. 20B is a sectional view thereof, and FIG. 21 is a sectional view illustrating the surface of the rib. The ink cartridge main body 1001 is provided with an air introducing groove 1031 and a negative pressure generating material adjusting chamber 1032 in a rib 1005 which functions as a partition between the ink accommodating portion 1006 and the negative pressure generating material accommodating portion 1004. The air introducing groove 1031 extends from a central portion of the rib 1005 to an end thereof, that is, the gap 1008 between the bottom of the ink cartridge 1011, adjacent the negative pressure generating material accomodating portion 1004. Between the negative pressure generating material 1003 adjacent to the air introducing groove 1031 of the rib 1005, a negative pressure generating material adjusting chamber 1032 is formed as a concavity.

Figure 22:
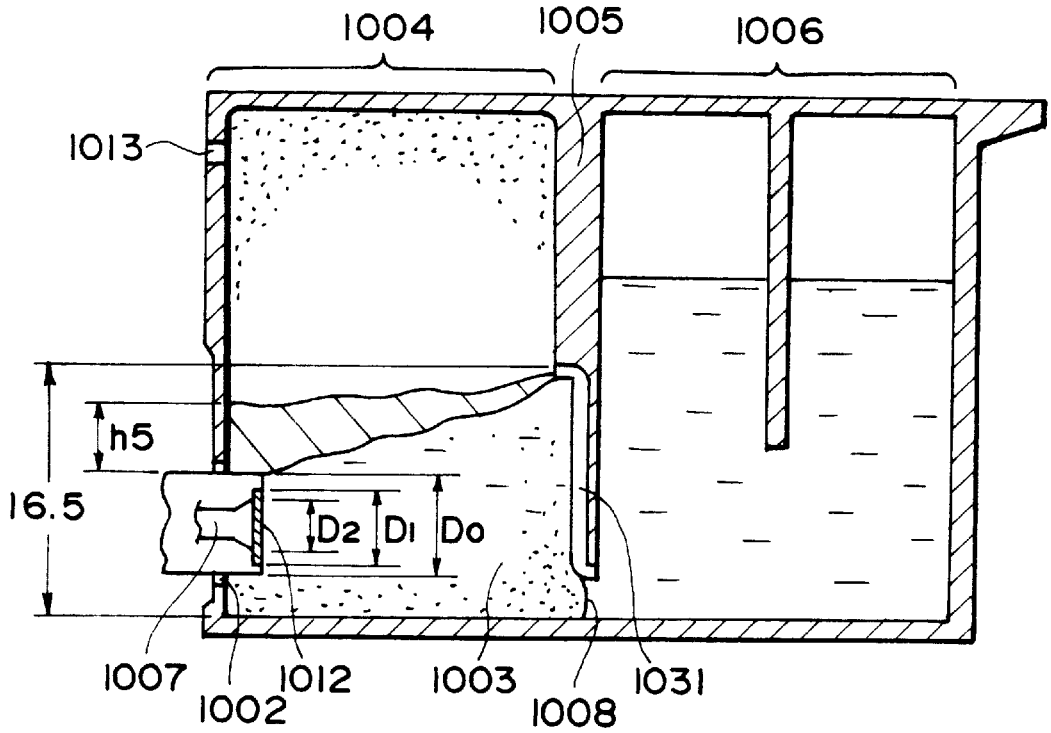
FIG. 22 illustrates an optimum range of the ink level.

Since the negative pressure generating material 1003 is contacted to the inside surface of the accommodating portion 1004 therefor, the contact pressure (compression) to the negative pressure generating material 1003 is partly eased even if the negative pressure generating material 1003 is non-uniformly inserted, as shown in FIG. 22. For this reason, when the ink starts to be consumed through the recording head, the ink contained in the material 1003 is consumed to reach the material adjusting chamber 1032. When the consumption of the ink is continued, the air can easily break the ink meniscus at the portion where the contact pressure is eased, so that the air is smoothly introduced into the air introducing groove 1031, and therefore, the negative pressure can be easily controlled.

The structure including the rib, the adjusting chamber or another structure having the equivalent function, are called an air-liquid exchange promoting structure. In the ink cartridge having this structure, the ink level optimum zone can be provided by adjusting the level of the top of the air-liquid exchange promoting structure disposed on the first accommodating chamber side wall. above the communicating portion between the first accommodating chamber and the second accommodating chamber.

As a means for controlling the optimum zone of the ink level, the direction of the compression and the compression ratio of the negative pressure generating material may be changed, as described hereinbefore. However, the adjustment of the top of the air-liquid exchange promoting structure is effective from the standpoint of certainty and reproducibility. These methods may be combined to provide the optimum zone of the ink level.

An example will be described.

FIG. 22 shows an embodiment provided with an air-liquid exchange promoting structure. As shown in FIG. 22, a recess is formed at a bottom end adjacent the negative pressure generating material accommodating portion 1004 of the partition 1005, and air introducing groove 1031 is formed extended upwardly from the communicating portion 1008. The air introducing groove 1031 is effective to promote the supply of the ink to the ink accommodating portion 1006 when a negative pressure is produced in the ink accommodating portion 1006 by the ink in the ink accommodating portion 1006 is guided in the negative pressure generating material accommodating portion 1004 through the communicating portion 1008, Therefore, the portion above the top of the air introducing groove 1031 is filled with an air supplied through the air communicating portion 1013. In other words, depending an the location of the top of the air introducing groove 1031 which is the air-liquid exchange promoting structure, the ink level in the accommodating chamber 1004 can be adjusted.

FIG. 22 shows an optimum height of the top of the air-liquid exchange promoting mechanism of this embodiment. The top of the mechanism is at a position not less than 5 mm higher than the top of the ink supply opening. This is because the top limit of the ink level, as described hereinbefore, is 5 mm above the top end of the end of the point member 1007 (ink supply port) inserted into the opening 2.

That is, in such an ink jet cartridge, the top limit of the ink level is 5 mm higher than the top of the ink supply port, and the lower limit of the ink level is the top end of the effective diameter D2 of a filter 1012 provided in the ink supply opening, further preferably, the top end of the outer diameter D1 of the filter 1012, further preferably the top end of outer diameter D0 of the ink supply port. Therefore, the most preferable range of the optimum zone of the ink level is limited by a position 5 mm higher than the top end from the top end of the ink supply opening. Tn this embodiment, the height of the top is 16.5 mm from the bottom of the inside of the cartridge, by which the optimum ink level zone can be accomplished.

If it is higher than 16.5 mm, the liquid level is raised toward the air vent position. Therefore, when the air layer having replaced and contained in the second chamber or the air layer in the negative pressure generating material are expanded due to the temperature or pressure change in the ambient condition, the ink may tends to leak through the air vent. On the other hand, if the position is lower than 16.5 mm, the ink level lowers, and therefore, an air layer is formed around the supply pipe inserted. During the recording operation or during the sucking recovery operation, the air may be introduced into the recording head with the result of tendency of the output image disturbance.

Figure 23:
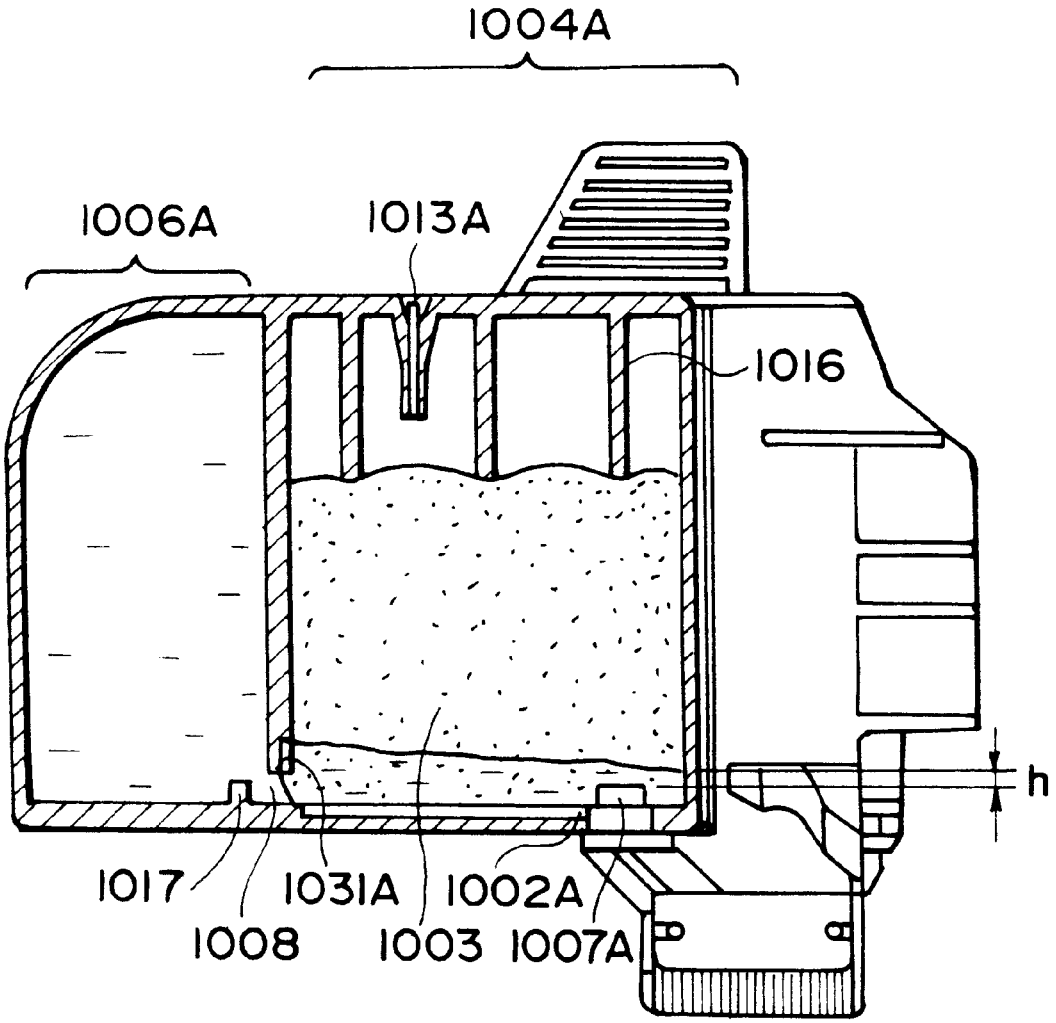
FIG. 23 illustrates a desirable ink level according to a further embodiment of the present invention.

The optimum zone of the ink level is not proper only for the cartridge of this embodiment. However, it is usable with an ink jet recording head integrally having an ink container and an ink ejecting portion, the ink container having a first and second chambers as shown in FIG. 23. The structure of the ink jet head shown in FIG. 23 is such that the ink supply opening 1002A is in the bottom side of a first accommodating chamber, that is, a negative pressure generating material accommodating portion 1004A, and through the opening 1002A, a joint 1007A of the ink ejecting portion is inserted. In the ink jet cartridge, an air introducing groove 1031A (air-liquid exchange promoting mechanism) is provided. At an upper position of the negative pressure generating material accommodating portion 1004A, a stop rib 1016 is provided. By this, a portion without the negative pressure generating material 1003 is formed at an upper portion of the accommodating portion 1014A. The air vent 1013A is in communication with the material absent zone. Adjacent the bottom communicating portion 1018 of the ink accommodating portion 1016A, a projection 1017 is formed, which functions to prevent introduction of ink or dew liquid into the accommodating portion 1014 through the communicating portion 1008, when the cartridge is turned upside-down. Also, in the ink jet cartridge of this structure, the level of the top of the air introducing groove 1031A of the air-liquid exchange promoting region is preferably higher than 5 mm higher position above the ink supply port plane. In addition, the optimum ink level of the cartridge is lower than a position 5 mm higher than the plane of the ink supplying opening at an end of the joint 1007A. More particularly, the upper limit of the optimum ink level is the level of the top of the air introducing groove 1031A which is the air-liquid exchange promoting region, and preferably, it is a position 5 mm higher than the plane of the ink supply port. On the other hand, the lower limit is a position 1 mm higher than the plane of the ink supply opening, further preferably, it is a position 2 mm higher than the ink supplying plane. Therefore, the preferable range of the ink level is between 2 mm higher than the top end of the ink supply port and a position 5 mm higher than that.

As described in the foregoing, by placing the ink level in a region lower than 5 mm higher than the top end of the ink supply opening of the ink cartridge, then an ink jet cartridge which provides stabilized ink supply with proper negative pressure, cartridge be provided.

Particularly, by controlling the ink level by the air-liquid exchange promoting mechanism, further correct proper zone can be provided.

As described in tho foregoing, according to the present invention, the ink in the ink accommodating portion and the ambient air can be smoothly and stably exchanged during the ink supply. As a result, the internal pressure in the ink supply portion can be stably controlled. A high speed printing is possible with high stability of ejection of the recording head. Against the pressure change in the ink container against the ambient condition change, the ink leakage does not occur.

The description will be made as to the ink preferably usable with the embodiment. The preferable ink provides an ink interface in the negative pressure generating material against vibration of the ink container. In addition, the air-liquid interface is stabilized against ambient condition change. For this purpose, the surface Lension of the ink is preferably 20 dyne/cm–55 dyne/cm, further preferably, 25 dyne/cm–50 dyne/cm. When the ink surface tension is in this range, the ink does not leak when the printing operation is not carried out, as a result of break of the meniscus at the orifice.

The desired surface tension can be provided by mixing water with water soluble organic solvent such as ethanol (22 dyne/cm), isopropanol (22 dyne/cm), cyclohexanol (34 dyne/cm), glycerin (63 dyne/cm), diethylene glycol (49 dyne/cm), diethylene glycol monomethylether (35 dyne/cm), polyethylene glycol (35 dyne/cm), 2-pyrrolidone (47 dyne/cm), N-methylpyrrolidone (41 dyne/cm), the surface tension being the values at 20–30° C.

The description will be made as to the method of controlling the surface tension using surface active agent. For example, 1% (on the basis of the weight of the water) of sorbitan monolaurate provides 28 dyne/cm, and 1% addition of polyoxysorbitan monolaurate provides 35 dyne/cm. In the case of 1% addition of acetylenol EH (EO additive of acetylene glycol) provides 28 dyne/cm. When a lower surface tension is required, fluorine surface active agent such as Surfron S-145 (available from Asahi Garasu Kabushiki Kaish (EO additive of perfluroalkyl) provides by 0.1% a addition 17 dyne/cm. Since the surface tension changes by another additives, and a proper adjustment is effected.

Figure 24:
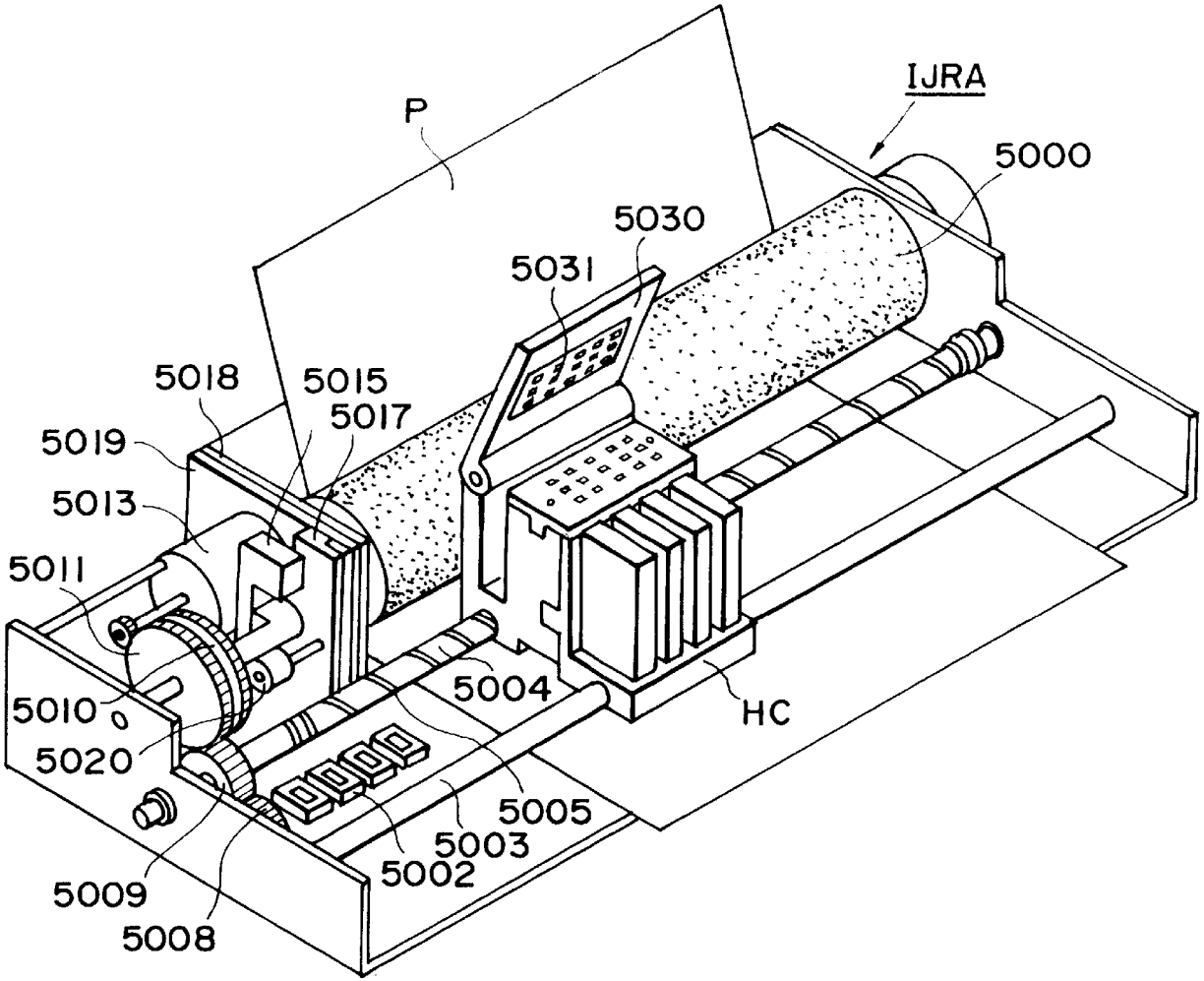
FIG. 24 is a sectional view of an ink jet printing apparatus, in a further example.

FIG. 24 is a perspective view of an outer appearance of an ink jet recording apparatus capable of carrying a recording head unit described in the foregoing.

In FIG. 24, forward or backward rotation of a driving motor 5013 is transmitted to a lead screw 5004 by way of drive transmission gears 5011 and 5009 to rotate it. The carriage HC has a pin (not shown) engaged with a helical groove 5005 of the lead screw 5004. By this, the carriage HC is reciprocated in the longitudinal direction of the apparatus. Designated by a reference numeral 5002 is a cap for capping the front side of the recording head in the recording head unit, and is used for suction recovery of the recording head through the cap by an unshown sucking means. The cap 5002 is capable of capping the ejection side surface of each of the recording heads by driving force transmitted by way of gear 5008 or the like. A cleaning blade 5017 is movable to and from and is supported on a supporting frame 5018 of the main assembly. The blade is not limited to this type, but another known blade is usable.

The capping, cleaning, sucking recovery operations are possible when the carriage takes a home position, by the lead screw 5005. However, they can be carried out at another proper timing.

Connection pads 4502 of the recording head unit mounted on the carriage NC are connected with connection pads 5031 by rotation of a connecting plate 5030 of the carriage HC about a predetermined axis, by which the electrical connection therebetween is established. Without using connector or the like, and therefore, the recording head does not receive unnecessary force.

Figure 25:
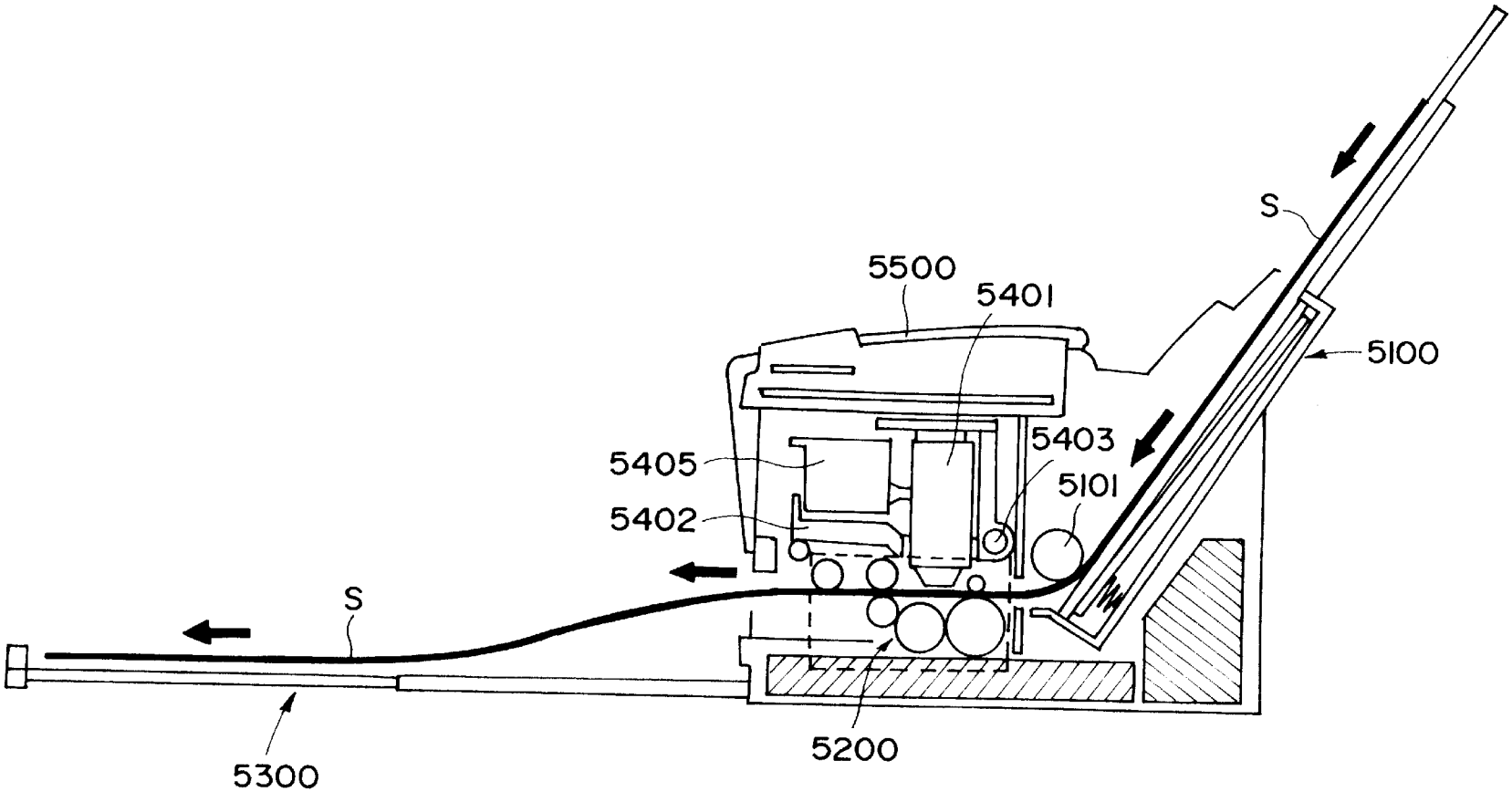
FIG. 25 is a sectional view of another example of an ink jet printing apparatus.

Referring to FIG. 25 another example of an ink jet printing apparatus usable with the ink jet cartridge according to this invent ion is usable. In FIG. 25, there is provided an automatic sheet feeder 5100 for supporting a stack of sheets S, and for feeding them one-by-one. A feeder 5200 functions to supply the recording sheet S singled out of the automatic feeder 5100 to a recording position, and also to feed the recording sheet to the discharge portion 5300. A recording head 5401 functions to eject yellow, magenta, cyan and black inks for the purpose of color recording, in this embodiment. A carriage 5402 for carrying the recording head 5401 is guided by a guiding shaft 5403 for guiding the carriage 5402 in a direction perpendicular to the surface of the sheet in the Figure by an unshown timing belt. A carriage driver functions to scanningly move the carriage 5402 carrying recording heads 5401 and ink containers 5405 for supplying the ink thereto. Above this, a controller 5500 is disposed for controlling the entirety of the recording apparatus on the basis of record data or information supplied from an unshown host computer or the like. Here, the recording heads 5401 and the ink containers 5405 constitute an ink jet head unit of the invention, and they are detachably mountable.

In this embodiment, the recording head must suitably use film boiling bubble creation system to eject the ink.

As described in the foregoing, by the use of the air-liquid exchange mechanism, the ink cartridge can be mounted or demounted without adverse influence to the mounting portion of the ink jet head. In other words, the ink cartridge can be mounted without exerting unnecessary external force to the ink jet head.

In addition, proper negative pressure can be maintained from the initial stage to the last stage during the recording, or when the recording operation is not effected. Therefore, a high speed recording is possible even when the use ambient condition is changed without ink leakage, in a replaceable type ink cartridge.

Furthermore, the replaceable type ink cartridge is easy to handle, and upon the mounting to the ink jet recording head, there occurs no ink leakage, and therefore, erroneous operation can be avoided.

Furthermore, by the bonding and sealing of press-contact member of the joint portion of the recording means to the external wall, is effective to prevent ink leakage even when the internal pressure of the container increases by worst ambient condition change, thus tending to discharge the ink. Therefore, a highly reliable ink jet recording head can be provided.

While the invention has been described with reference to the structures disclosed herein, it is not confined to the details set forth and this application is intended to cover such modifications or changes as may come within the purposes of the improvements or the scope of the following claims.

What is claimed is:

1. An ink jet unit comprising:

an ink cartridge for containing ink having a partition therein forming a first ink chamber for containing the ink and a second ink chamber containing a negative pressure producing material, a receptor port in a side of the second ink chamber opposed to said partition, a communication opening for fluid communication between the first ink chamber and the second ink chamber, wherein said partition extends from the communication opening and includes air introducing means for stably introducing air from the second ink chamber into the first ink chamber, a top end of said air introducing means being above a top of the communication opening; and an ink jet head including an ink supply member in contact with said negative pressure producing material through said receptor port for supplying ink from said ink cartridge to said ink jet head, wherein a gap is formed between said receptor port and said ink supply member when said ink supply member is in contact with said negative pressure producing material, and including a sealing member for effecting sealing at an outside portion of the gap with the gap remaining, wherein said air introducing means is constructed so that an ink level in said negative pressure producing material is no more than 5 mm above a top level of said receptor port as ink is supplied to said ink jet head.

2. An ink jet unit according to claim 1, wherein said ink supply member comprises a pipe having a reduced portion disposed in said ink cartridge when said ink supply member is in contact with said negative pressure producing material.

3. An ink jet unit according to claim 1, further comprising a press-contact member between the gap and ambient surroundings when said ink supply member is in contact with said negative pressure producing material, said press-contact member being provided in either said ink jet head or said ink cartridge.

4. An ink jet unit according to claim 3, wherein said press-contact member elastically deforms more than a material constituting said ink cartridge.

5. An ink jet unit according to claim 1, wherein a bubble is formed in the ink using thermal energy to eject the ink.

6. An ink jet unit according to claim 1, wherein the ink level is at least 2 mm above said top level of said receptor port as ink is supplied to said ink jet head.

7. An ink jet unit according to claim 1, wherein the gap is at least 0.3 mm.

8. An ink jet unit according to claim 1, wherein the gap is at least 0.6 mm.

9. An ink jet unit according to claim 1, wherein said ink supply member is in the form of a horn toward a free end thereof contactable to the negative pressure producing material.

10. An ink jet unit according to claim 1, wherein said ink supply member of said ink jet head is generally cylindrical, and further comprising a seal member provided at a base portion of said ink supply member, said seal member for isolating a connecting portion between said ink cartridge and said ink jet head, when they are connected.

11. An ink jet unit according to claim 1, wherein said air introducing means extends only partly along said partition from said communication opening, said air introducing means extending not less than 5 mm higher than a top level of said receptor port such that an ink level in said negative pressure producing material is no more than 5 mm above a top level of said receptor port.

12. An ink container detachably mountable to an ink jet head having an ink supply member, and an adjacent sealing member, said ink container for containing ink and including:

a partition in the ink container forming a first ink chamber for containing the ink and a second ink chamber containing a negative pressure producing material;

a receptor port in a side of the second ink chamber opposed to said partition, said receptor port having an inner diameter such that when said negative pressure producing material is contacted to said supply member, a gap is formed between said receptor port and said supply member, said sealing member for effecting sealing at an outside portion of the gap with the gap remaining; and a communication opening for fluid communication between the first ink chamber and the second ink chamber, wherein said partition extends from the communication opening and includes air introducing means for stably introducing air from the second ink chamber into the first ink chamber, a top end of said air introducing means being above a top of the communication opening, by which said ink supply member of said ink jet head contacts with said negative pressure producing material through said receptor port for supplying ink from said ink cartridge to said ink jet head, and said air introducing means is constructed so that an ink level in said negative pressure producing material is no more than 5 mm above a top level of said receptor port as ink is supplied to said ink jet head.

13. An ink container according to claim 12, wherein the ink level is at least 2 mm above said top level of said receptor port as ink is supplied to said ink jet head.

14. An ink container according to claim 12, wherein the gap is at least 0.3 mm.

15. An ink container according to claim 12, wherein the gap is at least 0.6 mm.

16. An ink jet head connectable with an ink cartridge having a negative pressure producing material therein, comprising:

an ink supply member contactable to said negative pressure producing material when said ink supply member is inserted into the ink cartridge; and an ink ejection head portion for ejecting the ink supplied from said ink cartridge through said ink supply member, wherein said ink supply member is generally cylindrical and has a reduced outer shape the diameter of which decreases in a direction away from a distal end of said ink supply member.

17. An ink jet head according to claim 16, wherein the reduced outer shape has a diameter which decreases toward said ink ejection head portion.

18. An ink jet unit comprising:

an ink cartridge for containing ink having a partition therein forming a first ink chamber for containing the ink and a second ink chamber containing a negative pressure producing material, a receptor port in a side of the second ink chamber opposed to said partition, a communication opening for fluid communication between the first ink chamber and the second ink chamber, wherein said partition extends from the communication opening and includes air introducing means for stably introducing air from the second ink chamber into the first ink chamber, a top end of said air introducing means being above a top of the communication opening; and an ink jet head including an ink supply member in contact with said negative pressure producing material through said receptor port for supplying ink from said ink cartridge to said ink jet head, wherein a gap is formed between said receptor port and said ink supply member when said ink supply member is in contact with said negative pressure producing material, and including a sealing member for effecting sealing of the gap at an outside portion of the gap, wherein said air introducing means is constructed so that an ink level in said negative pressure producing material is no more than 5 mm above a top level of said receptor port as ink is supplied to said ink jet head.

19. An ink container detachably mountable to an ink jet head having an ink supply member and an adjacent sealing member, said ink container for containing ink and including:

a partition in the ink container forming a first ink chamber for containing the ink and a second ink chamber containing a negative pressure producing material;

a receptor port in a side of the second ink chamber opposed to said partition, said receptor port having an inner diameter such that when said negative pressure producing material is contacted to said supply member, a gap is formed between said receptor port and said supply member, said sealing member for effecting sealing of the gap at an outside portion of the gap; and a communication opening for fluid communication between the first ink chamber and the second ink chamber, wherein said partition extends from the communication opening and includes air introducing means for stably introducing air from the second ink chamber into the first ink chamber, a top end of said air introducing means being above a top of the communication opening, by which said ink supply member of said ink jet head contacts with said negative pressure producing material through said receptor port for supplying ink from said ink cartridge to said ink jet head, and said air introducing means is constructed so that an ink level in said negative pressure producing material is no more than 5 mm above a top level of said receptor port as ink is supplied to said ink jet head.

* * * * *

UNITED STATES PATENT AND TRADEMARK OFFICE

CERTIFICATE OF CORRECTION

PATENT NO. : 6,286,944 B1
DATED : September 11, 2001
INVENTOR(S) : Shimizu et al.

It is certified that error appears in the above-identified patent and that said Letters Patent is hereby corrected as shown below:

Column 1,
Line 21, "effect" should read -- effective --.

Column 2,
Line 6, "ink" should be deleted;
Line 9, "Remaining" should read -- remaining --;
Line 36, "In" should read -- in --; and
Line 61, ";ink" should read -- ink --.

Column 3,
Line 7, "thereto" should read -- thereto. --; and
Line 24, "In" should read -- in --.

Column 4,
Line 11, "a" should read -- an --; and
Line 25, "Sectional" should read -- sectional --.

Column 5,
Line 17, "8." should read -- 8, --;
Line 38, "omitted In FIG. 2." should read -- omitted. --;
Line 39, "Recording" should read -- recording --;
Line 45, "Alternatively" should read -- Alternatively, --; and
Line 62, "with out" should read -- without --.

Column 6,
Line 10, "porcus" should read -- porous --; and
Line 43, "view" should read -- view of --.

Column 7,
Line 44, "then" should read -- the --.

Column 9,
Line 21, "weight:" should read -- weight --;
Line 39, "pressed" should read -- pressing --; and
Line 66, "manipulate" should read -- manipulates --.

Column 10,
Line 1, "of" should read -- or --;
Line 4, "example." should read -- example, --;
Line 5, "examples" should read -- example, -- and "nut" should read -- not --;
Line 10, "FIG. 8." should read -- FIG. 8B, --;

UNITED STATES PATENT AND TRADEMARK OFFICE

CERTIFICATE OF CORRECTION

PATENT NO. : 6,286,944 B1
DATED : September 11, 2001
INVENTOR(S) : Shimizu et al.

It is certified that error appears in the above-identified patent and that said Letters Patent is hereby corrected as shown below:

Column 10, cont'd
Line 31, "the." should read -- the --; and
Line 43, "Suction" should read -- suction --.

Column 11,
Line 1, "hereinbefore" should read -- hereinbefore, --;
Line 7, "case." should read -- case --;
Line 17, "The" should read -- At the --;
Line 25, "Pipe" should read -- pipe --;
Line 45, "hut" should read -- but --;
Line 60, ":is," should read -- is, --; and
Line 63, "that:" should read -- that --.

Column 12,
Line 19, "the." should read -- the --.

Column 13,
Line 18, "Change" should read -- change --;
Line 41, "above" should read -- above --; and
Line 54, "smaller" should read -- smaller --.

Column 14,
Line 32, "abovedescribed" should read -- above-described --; and
Line 54, "avoided" should read -- avoided. --.

Column 15,
Line 54, "cross-section.," should read -- cross-section, --;
Line 61, "Cf: should read -- of --; and
Line 66, "ink." should read -- ink --.

Column 16,
Line 1, "Supply" should read -- supply --;
Line 3, "Plate" should read -- plate --;
Line 12, "establish" should read -- established --; and
Line 45, "show" should read -- shown --.

Column 19,
Line 49, "peeled" should read -- being peeled --.

UNITED STATES PATENT AND TRADEMARK OFFICE

CERTIFICATE OF CORRECTION

PATENT NO. : 6,286,944 B1
DATED : September 11, 2001
INVENTOR(S) : Shimizu et al.

It is certified that error appears in the above-identified patent and that said Letters Patent is hereby corrected as shown below:

Column 20,
Line 44, "al" should read -- at --.

Column 21,
Line 9, "yap" should read -- gap --; and
Line 58, "inks" should read -- ink --.

Column 23,
Line 16, "wall." should read -- wall --;
Line 52, "end of the" (second occurrence) should be deleted; and
Line 64, "Tn" should read -- In --.

Column 24,
Line 6, "tends" should read -- tend --;
Line 55, "then" should be deleted; and
Line 61, "tho" should read -- the --.

Column 25,
Line 8, "Lension" should read -- tension --;
Line 31, "perfluroalkyl" should read -- perfluoroalklyl --;
Line 33, "additives," should read -- additive, --; and
Line 66, "invent ion" should read -- invention --.

Signed and Sealed this

Ninth Day of April, 2002

*Attest:*

*Attesting Officer*

JAMES E. ROGAN
*Director of the United States Patent and Trademark Office*